US005787054A

United States Patent [19]

Yasukawa et al.

[11] Patent Number: 5,787,054

[45] Date of Patent: Jul. 28, 1998

[54] PORTABLE ELECTRONIC DEVICE

[75] Inventors: Naoaki Yasukawa, Suwa; Chiaki Nakamura, Chiba, both of Japan

[73] Assignees: Seiko Epson Corporation, Tokyo; Seiko Instruments, Inc., Chiba, both of Japan

[21] Appl. No.: 694,719

[22] Filed: Aug. 9, 1996

[30] Foreign Application Priority Data

Aug. 31, 1995 [JP] Japan ..... 7-224320

[51] Int. Cl.[6] ..... G04B 1/00

[52] U.S. Cl. ..... 368/204; 368/203

[58] Field of Search ..... 368/10, 203, 204, 368/276, 281, 282

[56] References Cited

U.S. PATENT DOCUMENTS

| | | | |
|---|---|---|---|
| 4,182,110 | 1/1980 | Kamiwaki et al. | 368/64 |
| 4,450,843 | 5/1984 | Barney et al. . | |
| 4,733,265 | 3/1988 | Haraguchi et al. | 354/484 |
| 5,220,520 | 6/1993 | Kessoku | 364/708 |
| 5,328,781 | 7/1994 | Mikake | 429/97 |
| 5,347,163 | 9/1994 | Yoshimura | 307/66 |
| 5,375,246 | 12/1994 | Kimura et al. | 395/750 |

FOREIGN PATENT DOCUMENTS

| | | |
|---|---|---|
| 0 426 271 | 5/1991 | European Pat. Off. . |
| 0 591 557 | 4/1994 | European Pat. Off. . |
| 53-84774 | 7/1978 | Japan . |
| 61-234388 | 10/1986 | Japan . |

*Primary Examiner*—Bernard Roskoski
*Attorney, Agent, or Firm*—Eric B. Janofsky

[57] ABSTRACT

To achieve a multiple function portable electronic device providing improved ease of use by enabling the operation of selected functions to be sustained even while replacing the battery, switch end 190 is pushed out from battery housing hole 509 to one side by battery 59 when battery 59 is loaded, and is pushed by spring member 197 into battery housing hole 509 inside watch case 11 of the wristwatch-type pulse wave measuring device when battery 59 is removed from battery housing hole 509 after removing the battery cover. Switch end 190 thus automatically inputs the terminal voltage of a backup capacitance element from signal input terminal 510 to the IC. This causes the wristwatch-type pulse wave measuring device to switch from the normal operating mode to an energy conservation mode. Switch end 190 is a conductive plate 19 of which at least one part is a spring member with a chamfer 195 contacting side edge 591 of battery 59, and is used to establish an electrical connection between battery 59 and the capacitance element.

6 Claims, 19 Drawing Sheets

195

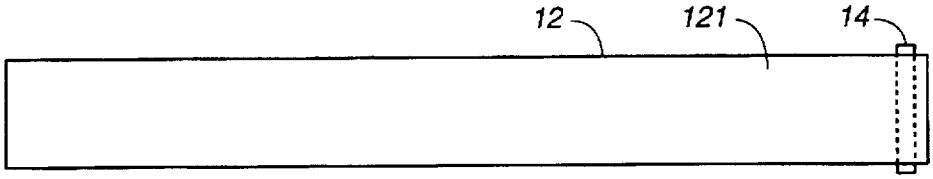
FIG._11A
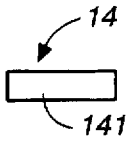
FIG._11B
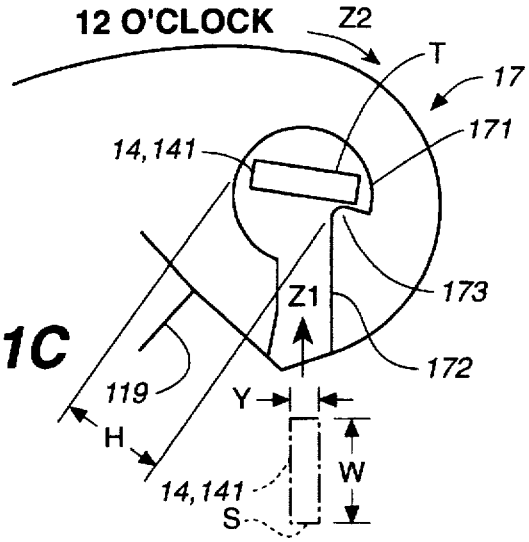
FIG._11C
FIG._12A
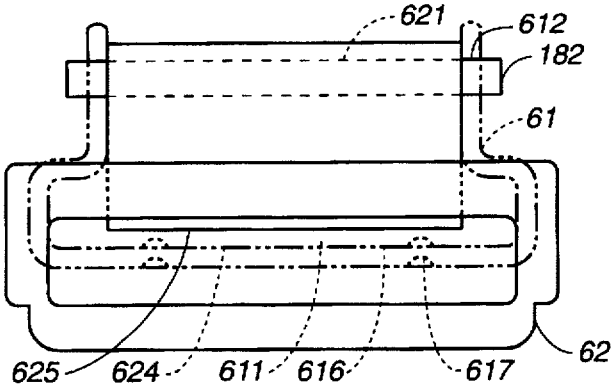
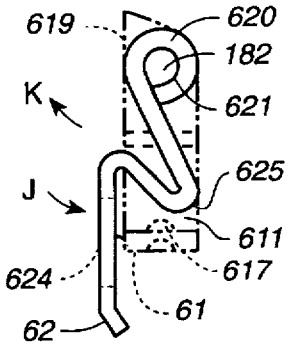
FIG._12B
FIG._14A
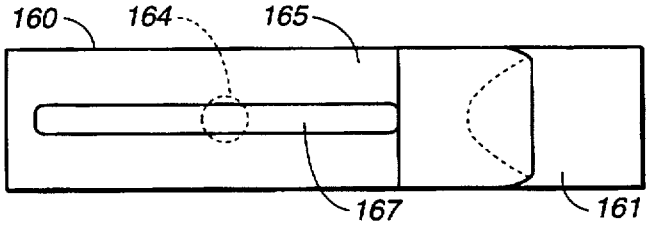
FIG._14B
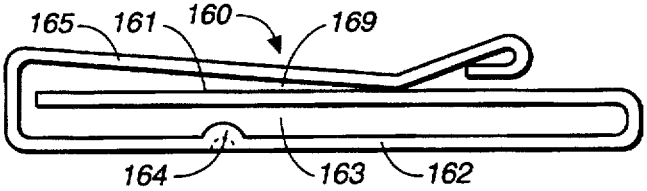

PORTABLE ELECTRONIC DEVICE

BACKGROUND OF THE INVENTION

1. Field of the Invention

The present invention relates to a portable electronic device comprising various functions in addition to conventional watch functions, and relates specifically to a mode selection technology associated with the presence of a battery.

2. Description of the Related Art

Portable electronic devices that the user may wear on the wrist or carry in the pocket include multiple function electronic devices providing such functions as a stopwatch, radio, and functions for measuring the pulse rate and other pulse information in addition to the functions of a normal watch. Such portable electronic devices generally comprise a battery cover on the back of the device body enabling the user to easily change the battery. Such portable electronic devices are therefore usually built with a capacitance element (auxiliary battery) to backup the memory device storing the time and other information. As a result, the information stored in the memory is retained even when all functions of the electronic device are interrupted as a result of removing the main power supply battery.

Unfortunately, while it would be convenient for the clock function and certain other functions to continue operating even when the main battery is removed, conventional multiple function portable electronic devices such as described above use the capacitance element only to backup the memory during battery replacement, and all functions, including the clock function, stop operating. When the clock function stops because the battery is removed, the clock must be reset after the new battery is installed. Ease of use is therefore less than optimum.

OBJECTS OF THE INVENTION

Therefore, it is an object of the present invention to overcome the aforementioned problems.

It is another object of the present invention is to provide a multiple function electronic device with such functions as a clock function and pulse information measuring function, whereby certain functions remain operable even while the battery is being replaced, and which therefore provides improved ease of use.

SUMMARY OF THE INVENTION

To achieve in a multiple function electronic device a portable electronic device whereby certain functions remain operable even while the battery is being replaced, a portable electronic device according to the present invention comprises a device body using a low profile case; a circuit board disposed in the case; a main battery housed in a battery housing hole in the case; an auxiliary battery electrically connected parallel to the main battery; a battery cover for opening and closing the battery housing hole to enable main battery replacement; a switching mechanism operating in conjunction with the installation and removal of the main battery from the battery housing hole; and a controller for controlling the watch and other operations of the device body.

Because the switching mechanism operates in conjunction with the installation and removal of the main battery from the battery housing hole according to the present invention, it is possible to automatically determine whether the main battery is in the battery housing hole. It is therefore possible to switch to a mode in which certain functions can continue to be used, insofar as those functions can be driven by the auxiliary battery or other memory backup capacitance element even when the main battery is removed from the battery housing hole to replace the main battery. Ease of use can therefore also be improved.

A mechanism comprising a switch end for connecting electrically with the auxiliary battery terminal can be used as the switching mechanism of the present invention. The switch end in this case is preferably comprised to contact the input terminal of the circuit board when the main battery is removed from the battery housing hole, and to input through the input terminal to the controller a signal corresponding to the terminal voltage of the auxiliary battery and indicating that there is no battery in the battery housing hole. When the main battery is housed in the battery housing hole, the switch end disconnects from the input terminal. It is therefore possible to automatically notify the controller whether the main battery is housed in the battery housing hole so that the controller can switch the operating mode accordingly. Moreover, because the switch end stops at a predetermined position in contact with the input terminal of the circuit board when it appears inside the battery housing hole, it does not move further into the battery housing hole. As a result, inserting the main battery into the battery housing hole does not flatten (mash) the switch end.

The switch end of the present invention may also be a member that is forced into the battery housing hole when the main battery is removed from the battery housing hole, is pushed out from the battery housing hole by the main battery when the main battery is housed in the battery housing hole, and thus connects with and disconnects from the input terminal.

The switch end in this case is preferably formed as an extension of the conductive plate electrically connecting the auxiliary battery terminal and the electrode of the main battery housed in the battery housing hole where the extension is specifically a spring member projecting into the battery housing hole.

Because the switching mechanism can be formed without increasing the wiring when thus comprised, it is suited to being disposed inside a low profile case. This construction is also advantageous in terms of the vibration resistance of the portable electronic device because there are no extraneous connection members.

The switch end may also comprise a chamfer facing the opening of the battery housing hole in a corner area of the battery housing hole. The switch end in this case is preferably comprised with the chamfer positioned in a peripheral area of the battery housing hole so that the switch end is pushed to the side outside the battery housing hole by the side edge of the main battery contacting the chamfer when the main battery is housed in the battery housing hole, and the switch end moves from this side position into the battery housing hole to contact the input terminal when the main battery is removed from the battery housing hole.

Because the switch end contacts the main battery through the chamfer when thus constructed, a structure whereby the switch end moves to the side can be simply achieved. Moreover, because the main battery will not catch on the switch end, the switch end will operate reliably even though simply constructed.

A portable electronic device according to the present invention preferably further comprises in the controller a mode switching means for switching from the normal operating mode to an energy conservation mode in which part of the operations executed by the device body are stopped when it is determined that there is no battery in the battery housing hole based on the signal input through the switching mechanism.

Because the energy conservation mode is automatically selected when the main battery is removed, if thus comprised, the clock and other few essential operations can be sustained for an extended period by means of the auxiliary battery or other capacitance element used for memory backup.

The energy conservation mode selected by the mode switching means of the present invention may comprise the following.

In a first aspect of the present invention, when the portable electronic device comprises a piezoelectric element for emitting an audible alarm, and a step-up means for emitting the audible alarm by increasing the voltage applied to the piezoelectric element, the controller preferably comprises a mode switching means for switching from a normal mode in which power is supplied to the step-up means to an energy conservation mode in which power is not supplied to the step-up means when it is determined based on the signal input through the switching mechanism that there is no battery in the battery housing hole.

In a second aspect of the present invention, when the portable electronic device comprises a sensor unit having an optical emitter and a receptor facing the finger surface, a cable leading from the sensor unit for inputting the optical detection result of the receptor to the device body, and a data processor for obtaining in the device body the pulse information to be displayed on a display unit based on the detection result of the receptor, the controller preferably comprises a mode switching means for switching from a normal mode in which the data processor processes the pulse information to an energy conservation mode in which the data processor does not process the pulse information when it is determined based on the signal input through the switching mechanism that there is no battery in the battery housing hole.

In a third aspect of the present invention, when the portable electronic device comprises a display unit for displaying various information, and a step-up means for obtaining the voltage required to display information on the display unit, the controller preferably comprises a mode switching means for switching from a normal mode in which power is supplied to the display step-up means to an energy conservation mode in which power is not supplied to the display step-up means when it is determined based on the signal input through the switching mechanism that there is no battery in the battery housing hole.

In a fourth aspect of the present invention, when the portable electronic device comprises a display unit for displaying various information, and a voltage detection means for detecting the voltage between the terminals of the main battery housed in the battery housing hole, the controller preferably comprises a mode switching means for switching to a mode displaying the detection result returned by the voltage detection means on the display when the main battery is housed in the battery housing hole after it is determined based on the signal input through the switching mechanism that there is no battery in the battery housing hole.

Because the voltage between the battery terminals is thus displayed when the main battery is replaced, the user can easily determine whether the newly installed main battery is a new battery or an old battery.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 11A is a plan view of the wrist band used in the wristwatch type pulse wave measuring device shown in FIG. 1A; FIG. 11B is an end view of the band holding pin attached to the end of the wrist band; and FIG. 11C is a cross-sectional view of the holder for the band holding pin shown in FIG. 11B;

FIG. 12A is a plan view of the band fastener taken in the direction of the six o'clock on the device body in the wristwatch type pulse wave measuring device shown in FIG. 1A, and FIG. 12B is a side cross-sectional view of the band fastener shown in FIG. 12A;

FIG. 14A is a plan view of the band holding means holding the end of the wrist band folded back on itself in the wristwatch type pulse wave measuring device shown in FIG. 1A, and FIG. 14B is a side view thereof;

DESCRIPTION OF THE PREFERRED EMBODIMENTS

The preferred embodiments of the present invention are described below based on the accompanying figures.

Overall configuration

Figure 1A:
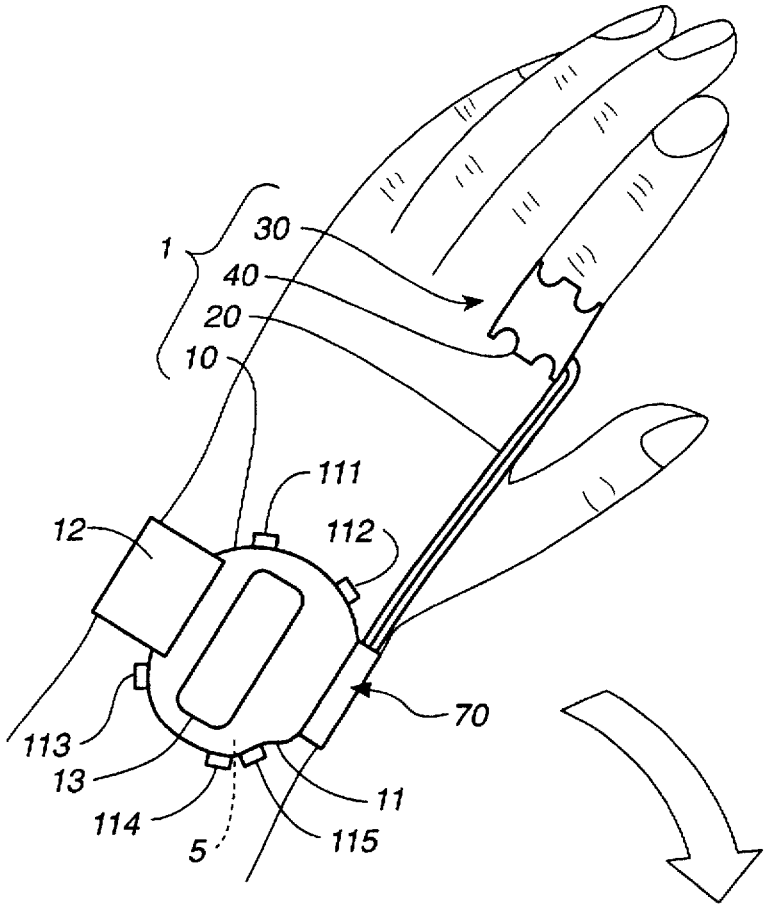
FIG. 1A is a perspective diagram showing a wristwatch type pulse wave measuring device.

FIGS. 1A and B show a wristwatch type pulse wave measuring device according to the present embodiment when in use.

Figure 1B:
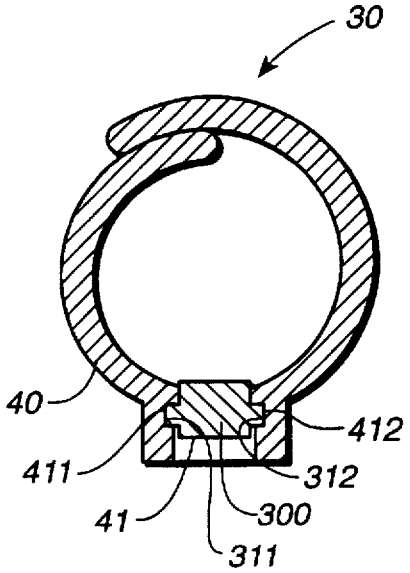
FIG. 1B is a cross-sectional view of a sensor unit according to a preferred embodiment of the present invention.

In FIG. 1A, wristwatch type pulse wave measuring device 1 (portable electronic device) according to the present embodiment comprises a device body 10 with a wristwatch construction, cable 20 connected to this device body 10, and sensor unit 30 provided on the end of this cable 20. FIG. 1B shows a cross-sectional view of sensor unit 30.

Wrist band 12, which may be made from natural leather, synthetic leather, a synthetic textile, or a natural fiber textile, is disposed to device body 10 wrapping around the wrist from the direction of twelve o'clock on the wristwatch and fastened in the direction of six o'clock; this wrist band 12 enables device body 10 to be worn freely on the wrist. As shown in FIG. 1B, sensor unit 30 comprises a sensor securing band 40 approximately 10 mm wide, for example, and is held by sensor securing band 40 on the index finger between the knuckle and first joint.

Structure of the device body

Figure 2:
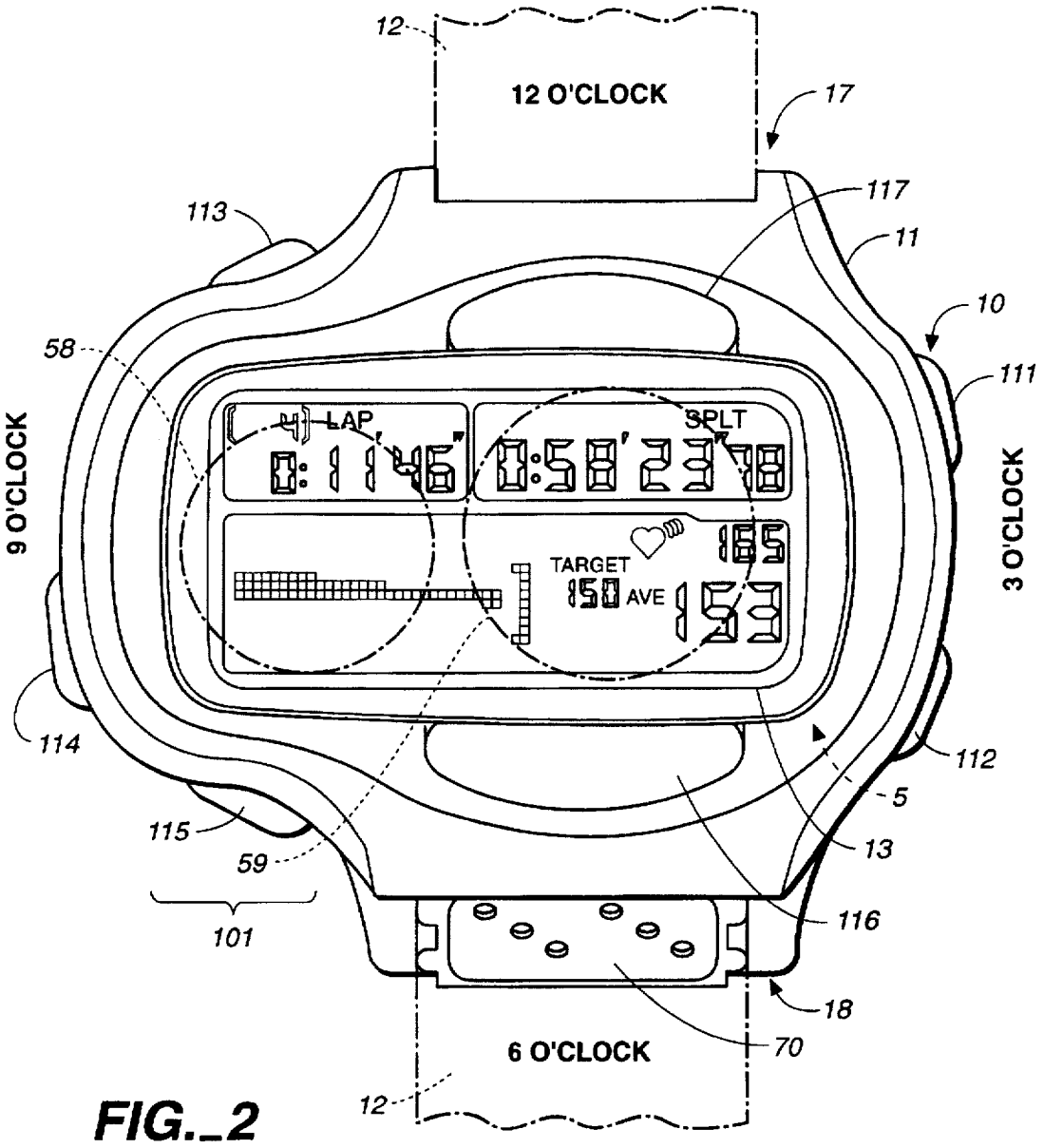
FIG. 2 is a plan view of the device body of the wristwatch type pulse wave measuring device shown in FIG. 1A.
Figure 3:
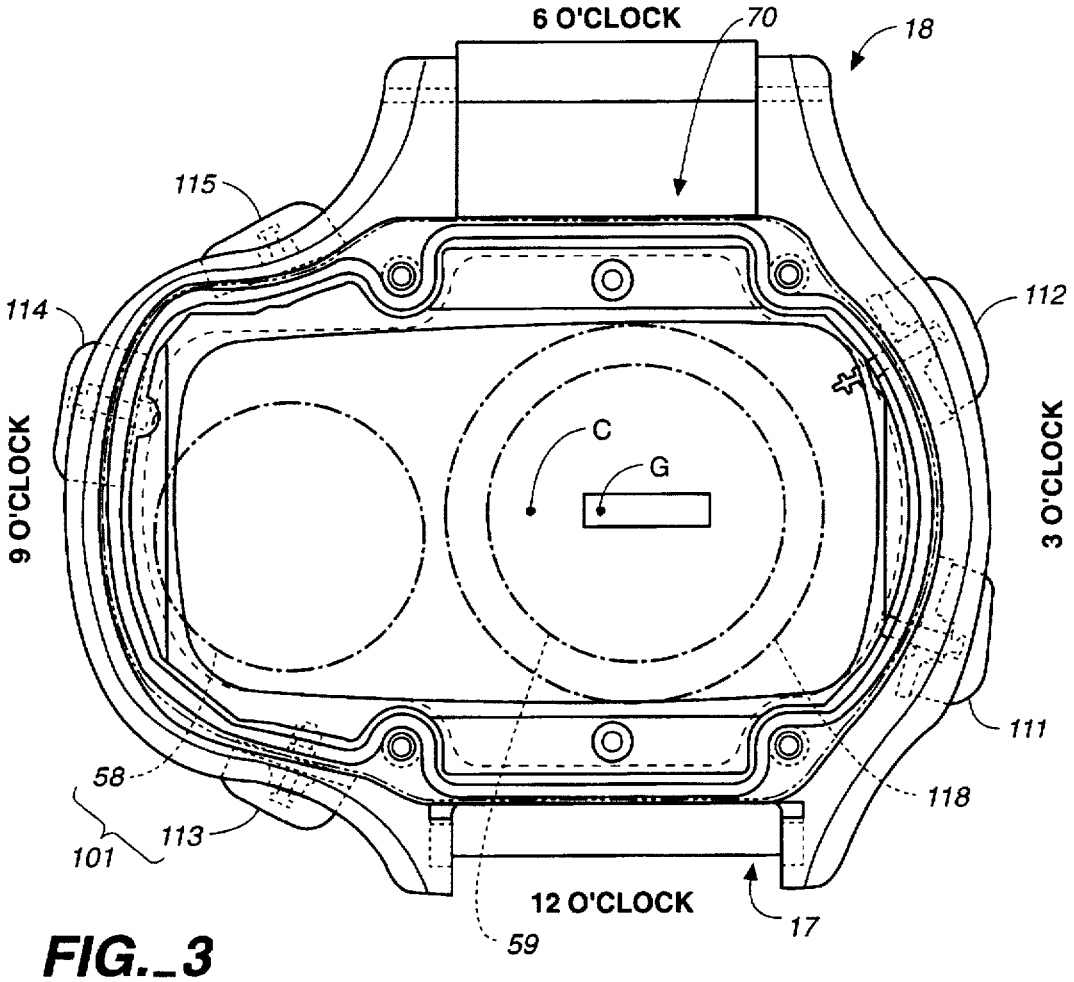
FIG. 3 is a bottom view of the device body of the wristwatch type pulse wave measuring device shown in FIG. 1A.

FIG. 2 is a plan view of the device body of the wristwatch type pulse wave measuring device shown in FIG. 1A with the wrist band and cables removed, and FIG. 3 is a bottom view of device body 10.

In FIG. 2, device body 10 comprises a resin watch case 11 (main case) with a display such as liquid crystal display device 13 (display) on the surface side of this watch case 11 for digitally displaying the pulse count and other pulse information in addition to the current time and date.

Controller 5, which controls such operations as displaying the change in pulse count based on the detection result (pulse signal) returned by sensor unit 30, is housed in watch case 11. A stopwatch circuit is also built in to controller 5, enabling the normal time, lap time, split time, and other time information to be displayed on liquid crystal display device 13.

Button switches 111–115 for setting the time, changing the display mode, and other functions are also provided on the outside of watch case 11. Button switches 116 and 117 are also provided on the face of watch case 11. The power supply for wristwatch-type pulse wave measuring device 1 is an energy source or storage element, such as, button battery 59 (main battery) housed inside watch case 11. Cable 20 supplies power from battery 59 to sensor unit 30, and inputs the detection results from sensor unit 30 to controller 5 inside watch case 11.

As the functions of wristwatch type pulse wave measuring device 1 are increased, it is also necessary to enlarge device body 10, but because of the limitations imposed by device body 10 being worn on the arm, device body 10 cannot be enlarged in the directions of six o'clock and twelve o'clock. A horizontally long watch case 11 in which the length in the direction from three o'clock to nine o'clock is greater than the length in the direction from six o'clock to twelve o'clock is therefore used for device body 10 in the present embodiment.

Wrist band 12 is therefore connected to this watch case 11 at a position offset toward the three o'clock position from the center position C in the direction from three o'clock to nine o'clock of this watch case 11. As a result, device body 10 has a large protrusion 101 in the direction of nine o'clock on the wristwatch when seen from the wrist band 12, but does not have a similarly large protrusion in the direction of three o'clock. As a result, the wrist can be bent with relative freedom and comfort even though the watch case 11 is long from side to side. The back of the hand will also not strike the watch case 11 when, for example, the user falls and the hand is bent back because there is no large projection in the direction of three o'clock. The wristwatch-type pulse wave measuring device 1 is also stable on the wrist because the large protrusion 101 at nine o'clock position is held tight to the arm. It is therefore also not necessary to use an unnecessarily wide wrist band 12 even though the watch case 11 is wide from side to side.

As shown in FIG. 3, a flat battery 59 for the power supply and a sound emitting element, such as, a flat piezoelectric device 58, are arrayed side by side in the planar direction (the directions of three o'clock and nine o'clock on the wristwatch) inside watch case 11, thereby enabling a low profile or thin device body 10 and, by providing battery cover 118 on back 119 of watch case 11, a structure whereby the user can easily replace battery 59.

While battery 59 is disposed at a position offset toward three o'clock from center position C, piezoelectric device 58 is disposed at a position offset toward nine o'clock from center position C. Thus, because battery 59 is heavier than piezoelectric device 58, the center of gravity G in the directions of three o'clock and nine o'clock on device body 10 is offset from the center position C in the direction of three o'clock. Wrist band 12 is therefore also connected on the side to which the center of gravity is offset, and device body 10 can be worn stably on the wrist.

Structure of the device body controller

Figure 4:
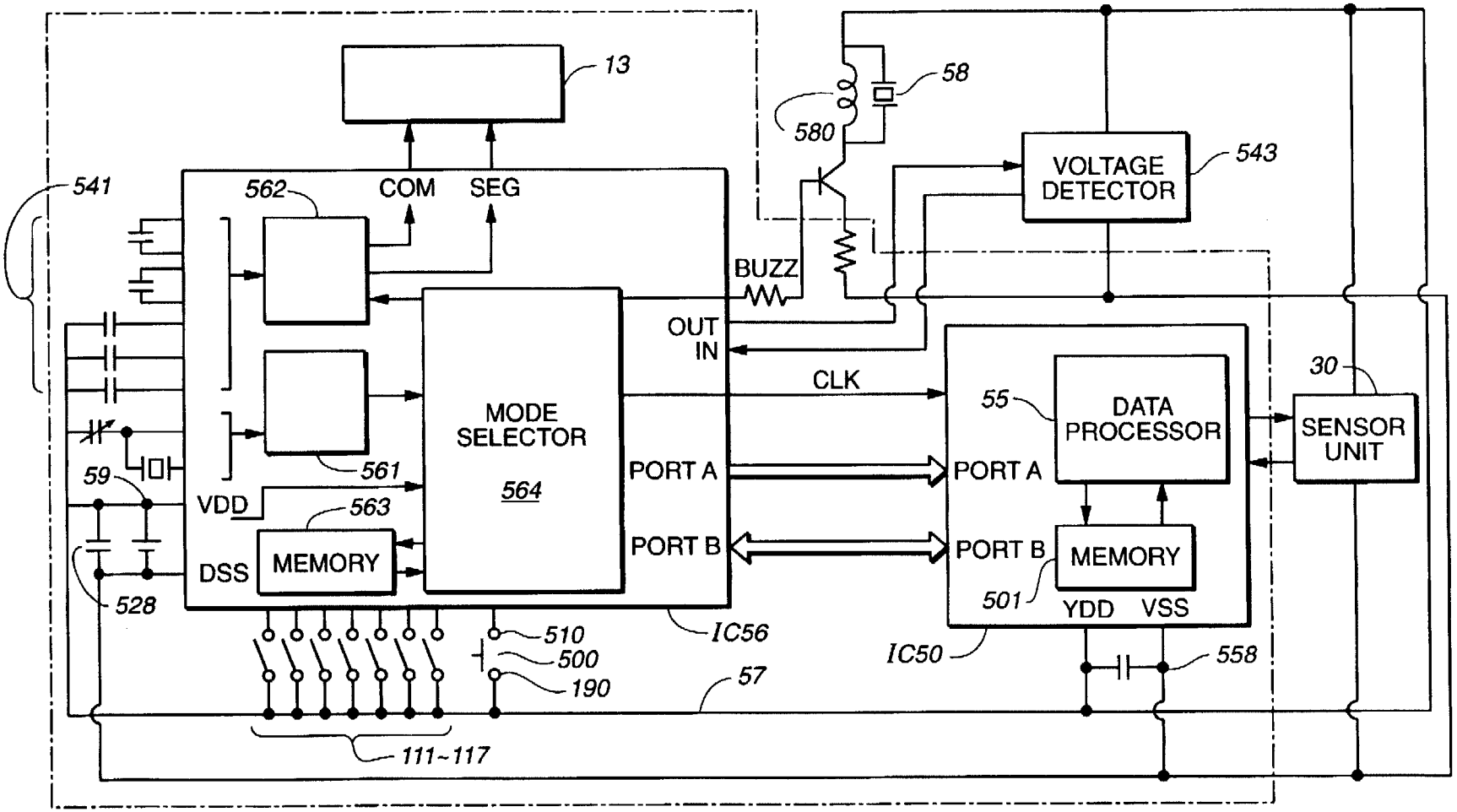
FIG. 4 is a functional block diagram showing a controller in the wristwatch type pulse wave measuring device shown in FIG. 1A.

FIG. 4 is a functional block diagram used to describe the controller in the device body of the wristwatch type pulse wave measuring device shown in FIG. 1A.

As shown in FIG. 4, controller 5 comprises two integrated circuits, IC 50 and IC 56. IC 56 comprises clock unit 561, LCD voltage step-up circuit 541, and LCD drive circuit 562. Clock unit 561 operates the clock based on a signal from an oscillation circuit, which comprises a quartz oscillator and variable capacitor. LCD voltage step-up circuit 541 (display voltage step-up means) generates the voltage required to drive LCD unit 13, and LCD drive circuit 562 drives the LCD unit 13. The content of the operations executed by button switches 111–115 of device body 10 are also input to IC 56.

Though described in greater detail below, IC 50 comprises data processor 55 for processing the detection signal input from sensor unit 30 to obtain the pulse count and other pulse information. This information can then be displayed on LCD unit 13 by means of data processor 55 outputting the pulse count and other pulse information to IC 56. Conversely, IC 56 outputs clock signal CLK to IC 50; clock signal CLK is required for data processor 55 to function.

Controller 5 comprises capacitance elements 528 and 558 wired in parallel to battery 59. Capacitance element 528 is the backup capacitor for memory 563 inside IC 56. Capacitance element 558 is the backup capacitor for memory 501 inside IC 50; the capacity of capacitance element 558 is greater than that of capacitance element 528 because it is used for the analog circuitry.

Note that capacitance elements 528 and 558 are used as auxiliary energy sources or storage elements supplying power when the main battery 59 is removed, and is used as the signal generating source notifying controller 5 that battery 59 has been removed.

Voltage detector 543 for detecting the voltage between the terminals of battery 59 and inputting the detection result to IC 56 is also disposed inside device body 10. Voltage detector 543 therefore makes it possible to display on LCD unit 13 when the terminal voltage of battery 59 has dropped. Piezoelectric element 58 for emitting an audible alarm, and alarm emitting step-up circuit 580 (alarm emitting step-up means) comprising a coil for stepping up and supplying to piezoelectric element 58 the voltage supplied from IC 56, are also disposed in device body 10.

Switching mechanism 500 for battery presence detection is inserted between IC 56 and line 57, which is electrically connected to the positive electrode of battery 59 and the terminals of capacitance elements 528 and 558. As described later below, switching mechanism 500 opens and closes in conjunction with the insertion and removal of battery 59.

IC 56 also comprises mode switching means 564 for monitoring whether the specified signal has been input from line 57 through switching mechanism 500, and switching from the normal mode to the energy conservation mode, which forcibly interrupts certain operations of device body 10, when it is determined that battery 59 has been removed.

In the mode switching operation of the present embodiment, mode switching means 564 stops the power supply to alarm emitting step-up circuit 580 when it is determined that battery 59 has been removed, and thus selects the energy conservation mode, and resumes supplying power to alarm emitting step-up circuit 580 when it is determined that battery 59 has been reinstalled, thus selecting the normal mode. When it is determined that battery 59 has been removed, mode switching means 564 also interrupts the clock signal CLK output to IC 50 (in the energy conservation mode), and resumes outputting the clock signal CLK to IC 50 when it is determined that battery 59 has been reinstalled (in the normal mode).

Mode switching means 564 also stops supplying power to the LCD voltage step-up circuit 541 when it is determined that battery 59 has been removed, and completely stops LCD unit 13 operation in the energy conservation mode by setting the common voltage and segment voltages to the same potential in LCD drive circuit 562; operation of LCD unit 13 is then resumed in the normal mode when it is determined that battery 59 has been reinstalled in device body 10.

Structure of the battery presence detection switching mechanism

The structure of the switching mechanism enabling the operation described above is described below with reference to FIGS. 5–8.

Figure 5:
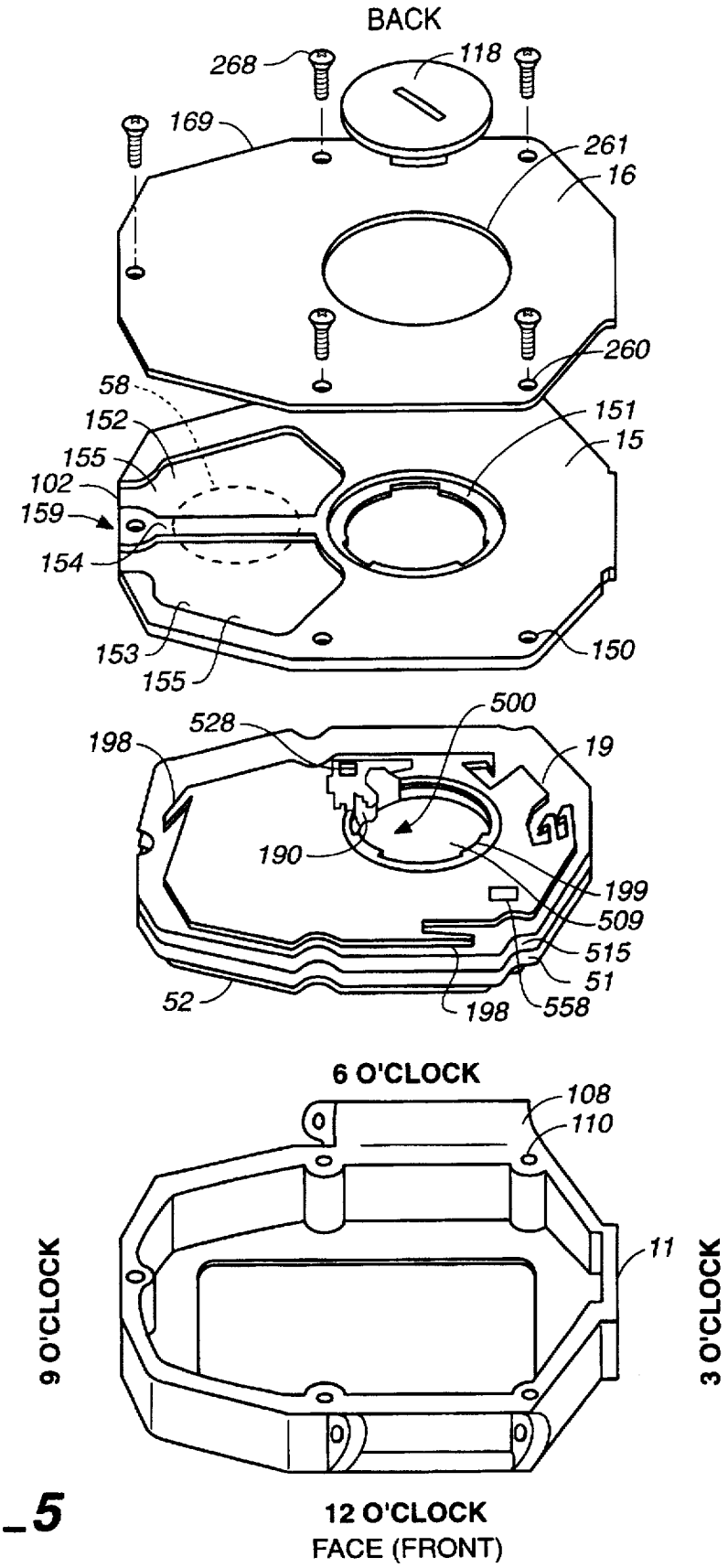
FIG. 5 is an exploded view depicting the construction of the back of the device body in the wristwatch type pulse wave measuring device shown in FIG. 1A.
Figure 6A:
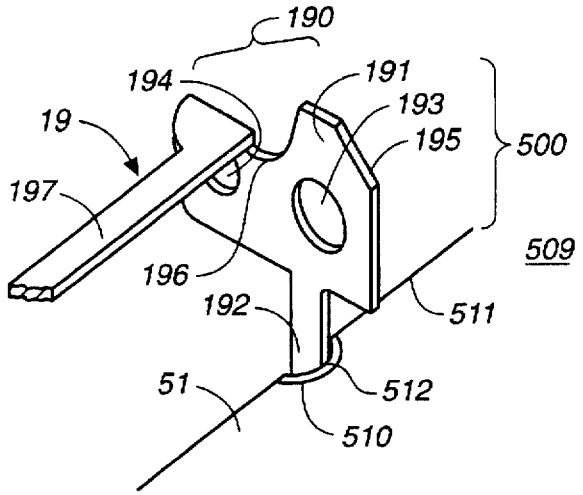
FIGS. 6A–C are oblique views depicting the operation of a switching mechanism for detecting battery presence in the wristwatch type pulse wave measuring device shown in FIG. 1A.
Figure 6B:
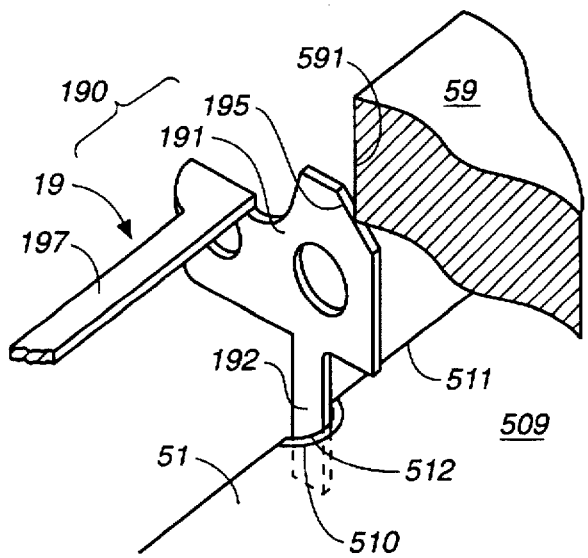
Figure 6C:
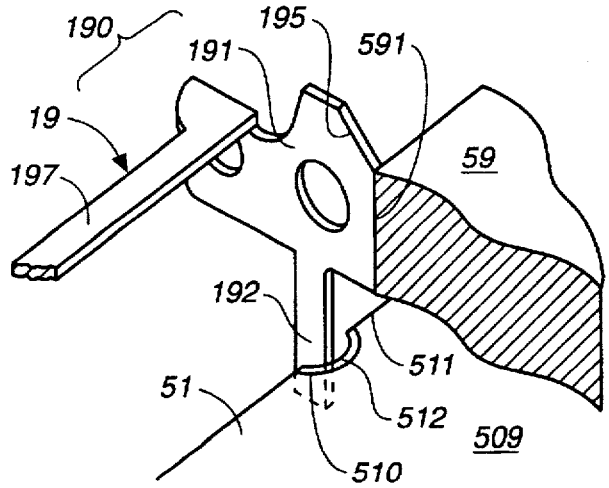
Figure 7:
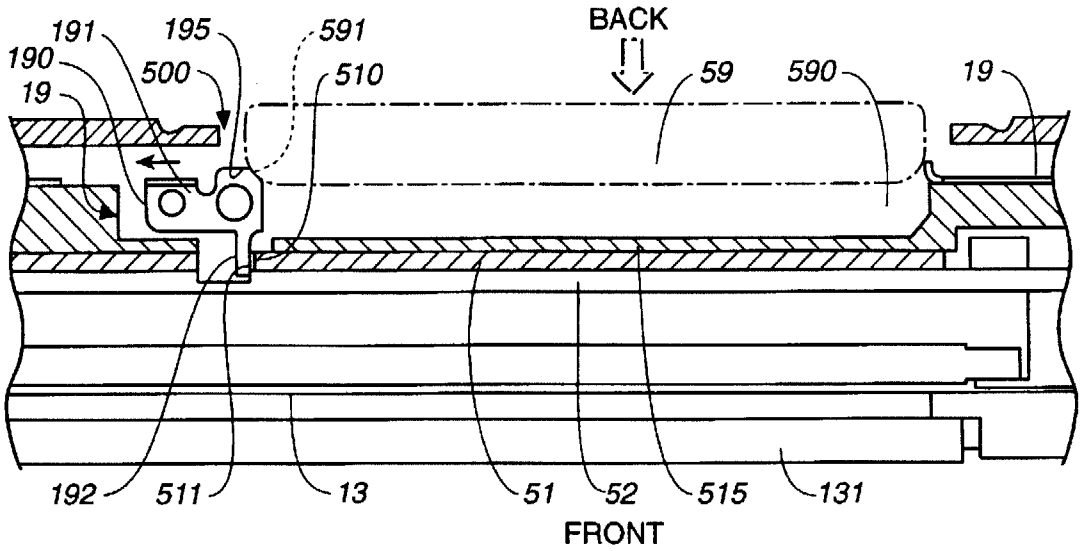
FIG. 7 is a vertical cross-sectional view showing the position of the switching mechanism for detecting battery presence in the wristwatch type pulse wave measuring device shown in FIG. 1A before the battery is inserted.
Figure 8:
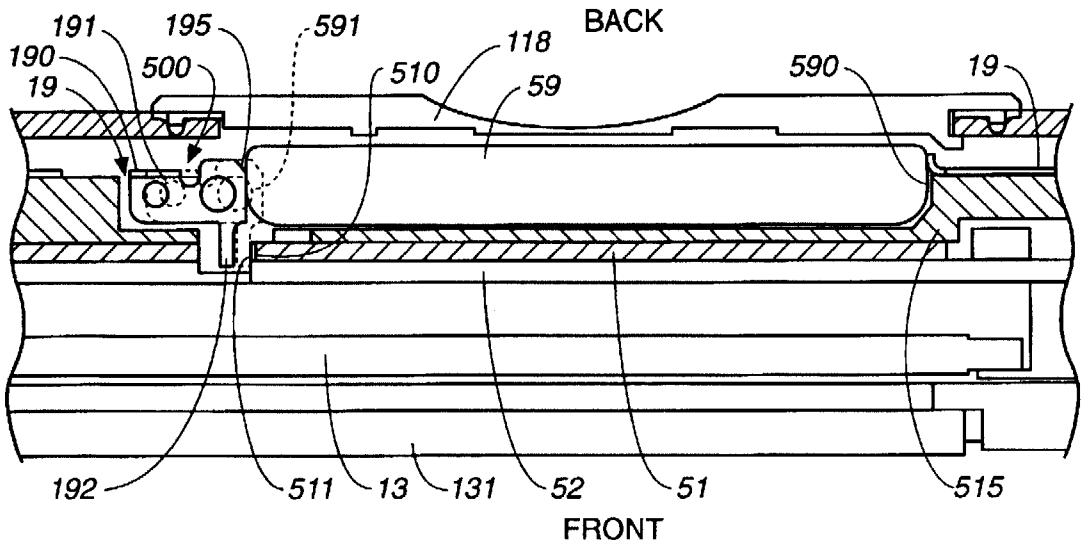
FIG. 8 is a vertical cross-sectional view showing the position of the switching mechanism for detecting battery presence in the wristwatch type pulse wave measuring device shown in FIG. 1A after the battery is inserted.

FIG. 5 is an exploded view with the back of the device body shown at the top and used to describe the construction of the back of the device body in the wristwatch type pulse wave measuring device according to the present embodiment. FIGS. 6A–C are enlarged views used to describe the operation of the switching mechanism, and FIGS. 7 and 8 are vertical cross-sectional views used to describe the operation of the switching mechanism.

As shown in FIG. 5, watch case 11 of the present embodiment is a thin frame structure of which the open back side is covered by first and second rear covers 15 and 16. More specifically, five screw holes 110 are formed in the back of watch case 11, and five corresponding holes 150 and 260 are formed in first and second rear covers 15 and 16 corresponding to the positions of screw holes 110. As a result, first and second rear covers 15 and 16 can be fastened to and removed from the back of watch case 11 using five screws 268.

First rear cover 15 is fabricated from, for example, a stainless steel plate approximately 0.8 mm thick with a hole 151 for accommodating battery 59 provided at a position offset toward the three o'clock position. Battery cover 118 covers this hole 151. Second rear cover 16 comprises, for example, a stainless steel plate approximately 0.3 mm thick with a larger hole 261 for accommodating battery 59 from hole 151 in first rear cover 15.

Of the various components housed in watch case 11, those shown in FIG. 5 are digital circuit board 52, analog circuit board 51, insulating spacer 515 disposed on the back of analog circuit board 51, and conductive plate. Note that conductive plate 19 is overlaid to analog circuit board 51 with insulating spacer 515 disposed therebetween. Holes are formed in conductive plate 19 and insulating spacer 515 at positions corresponding to holes 151 and 261. The holes in these various members collectively form battery housing hole 509 such that analog circuit board 51 is disposed at the inside end of battery housing hole 509.

Conductive plate 19 is a thin metal sheet that also functions as a circuit board presser plate holding analog circuit board 51 inside watch case 11. Terminal 199 projecting slightly to the inside of battery housing hole 509 is formed in conductive plate 19. Terminal 199 contacts the positive electrode covering the outside circumference of battery 59 when battery 59 is loaded in battery housing hole 509. Both conductive plate 19 and insulating spacer 515 are formed by stamping to a specific shape such that plural terminals 198 shaped as narrow extensions from the main conductive plate 19 are electrically connected by spring pressure to the pattern on analog circuit board 51. Two of these terminals 198 are electrically connected to one of the terminals of capacitance elements 528 and 558 mounted on analog circuit board 51. Conductive plate 19 thus forms line 57 shown in FIG. 4 electrically connecting the positive electrode of battery 59 with terminals of capacitance elements 528 and 558.

Switching mechanism 500, which detects whether battery 59 is loaded in battery housing hole 509, uses part of conductive plate 19 as switch end 190 in the present embodiment. Note that switch end 190 moves in conjunction with the placement of battery 59 in a peripheral area of battery housing hole 509.

An enlarged view of the conductive plate switch end 190 positioned in a peripheral area of battery housing hole 509 is shown in FIG. 6A.

As will be known from FIG. 6A, the part of conductive plate 19 forming switch end 190 comprises a long narrow spring member 197, end piece 191 bent from the end of spring member 197, and contact 192 projecting from end piece 191. Two holes 193 and 194 and recess 196 are formed in end piece 191 to reduce the weight of this member and thereby help prevent chattering in the contacts, which can easily occur as a result of shock applied, for example, by dropping the device body.

Chamfer 195 is also formed on end piece 191 rising toward the open side of battery housing hole 509 (upward in FIG. 6A). The part corresponding to the bottom of battery housing hole 509 is analog circuit board 51, which has recess 512 formed in the edge 511 thereof; contact 192 of switch end 190 fits into this recess 512. The no battery signal input terminal 510 is formed along the inside circumference part of recess 512 (on the edge 511 of analog circuit board 51). When positioned as shown in FIG. 6A, contact 192 of switch end 190 contacts and is electrically connected to no battery signal input terminal 510. By switch end 190 (contact 192) thus contacting no battery signal input terminal 510 in recess 512, chamfer 195 is positioned in a corner area of battery housing hole 509 after battery 59 is removed from battery housing hole 509. If chamfer 195 moves too far into battery housing hole 509 when battery 59 is removed, switch end 190 may be damaged by battery 59 when battery 59 is loaded in battery housing hole 509.

When battery 59 is loaded in battery housing hole 509 from the back of the device body with switching mechanism 500 thus comprised, side edge 591 of battery 59 first contacts chamfer 195 of switch end 190 as shown in FIGS. 6B and 7. When battery 59 is then pressed down into battery housing hole 509, switch end 190 is pushed to the side by battery 59 as shown in FIGS. 6C and 8, and is thus pushed out from battery housing hole 509. When battery housing hole 509 is then covered by battery cover 118, power (voltage) can be supplied from battery 59 as shown in FIG. 4.

Note that switching mechanism 500 is open in this condition. As a result, mode switching means 564 switches device body 10 to the normal mode, displays normally to LCD unit 13, supplies a voltage to alarm emitting step-up circuit 580 at the specified timing, and thus issues an alarm by means of piezoelectric element 58. The clock signal CLK is also output normally from IC 56 to IC 50, thereby enabling data processor 55 of IC 50 to calculate the pulse count and other pulse information based on the pulse signal input from sensor unit 30, and output the result to IC 56. During this time a charge from battery 59 is stored to capacitance elements 528 and 558. A voltage is also supplied to LCD voltage step-up circuit 541, thereby enabling LCD unit 13 to operate and display.

When operation continues for a sufficient period in this state and a signal indicating that the terminal voltage of battery 59 has dropped is input from voltage detector 543 to IC 56, information to this effect is displayed on LCD unit 13 to notify the user.

This prompts the user to replace the battery 59 by removing battery cover 118 and removing battery 59 from battery housing hole 509. This allows switch end 190, which is pushed and held to the side by the loaded battery 59 as shown in FIGS. 6C and 8, to move, as driven by spring member 197, causing end piece 191 to appear in battery housing hole 509 as shown in FIGS. 6A, 6B and 7. As a result, contact 192 of switch end 190 contacts and is electrically connected to no battery signal input terminal 510, which is formed on edge 511 of analog circuit board 51 as described above. Because switch end 190 is part of conductive plate 19, which is electrically connected to the terminals of capacitance elements 528 and 558, switch end 190 outputs a signal corresponding to the terminal voltage of capacitance elements 528 and 558 (indicating that battery 59 has been removed from battery housing hole 509 and no battery 59 is present in battery housing hole 509) to no battery signal input terminal 510.

When this signal is input, mode switching means 564, shown in FIG. 4, determines that battery 59 has been removed, and stops the power supply to alarm emitting step-up circuit 580, stops outputting the clock signal CLK to IC 50, stops the power supply to LCD voltage step-up circuit 541, and thus completely shuts down LCD unit 13 by setting the common voltage and segment voltages to the same potential. While in this energy conservation mode, power sufficient to maintain clock operation and backup memory devices 563 and 501 can be supplied for a sufficient period from capacitance elements 528 and 558. The data stored in memory devices 563 and 501 is therefore not lost, and it is not necessary to reset the clock after battery 59 is replaced because clock operation is sustained even while battery 59 is removed.

The operation for loading battery 59 is as described above. Note, however, that when battery 59 is pressed into battery housing hole 509, switch end 190 is pushed to the side by battery 59, thereby opening switching mechanism 500 and interrupting signal input. Power is not supplied from battery 59, however, until battery cover 118 is installed. Because this state is also monitored by voltage detector 543, mode switching means 564 only resumes supplying power to alarm emitting step-up circuit 580 and outputting the clock signal CLK to IC 50 once battery 59 is installed, battery cover 118 is replaced, and power supply from battery 59 can then be resumed. The power supply to LCD voltage step-up circuit 541 is also resumed at the same time to resume normal LCD unit 13 operation, and the terminal voltage of the newly loaded battery 59 detected by voltage detector 543 is immediately displayed on LCD unit 13 by mode switching means 564.

Structure of the alarm emitting resonation chamber

Referring again to FIG. 5, piezoelectric element 58 is disposed on the side of first rear cover 15 facing inside watch case 11 at a position offset toward nine o'clock. Two recesses 152 and 153 approximately 0.4 mm deep are formed in the back of first rear cover 15 in the area corresponding to piezoelectric element 58. As a result, that part of first rear cover 15 in which recesses 152 and 153 are formed is a thin wall 155 approximately 0.4 mm thick. Reinforcing rib 154 divides recesses 152 and 153 into two zones to maintain the strength of this thin wall 155. Note also that recesses 152 and 153 are formed in the back of first rear cover 15 extending to the outside edge 159 in the area of nine o'clock.

Figure 9:
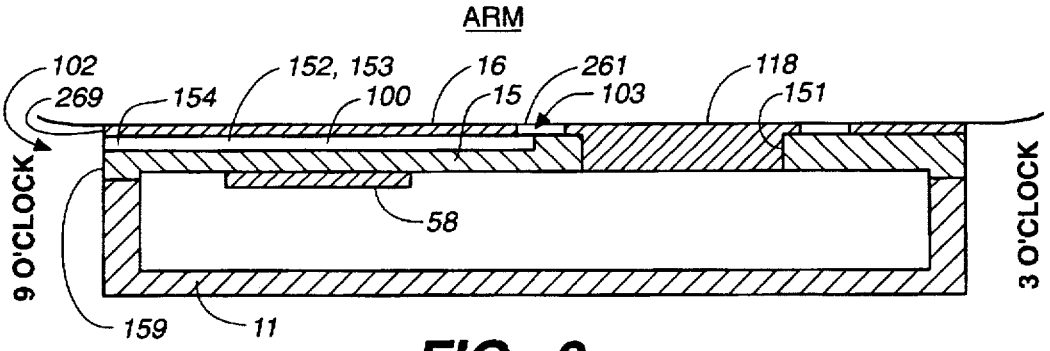
FIG. 9 is a cross-sectional view depicting a resonance chamber for the audible alarm comprising two back covers in the back of the device body shown in FIG. 5.

When second rear cover 16 is applied to the back of first rear cover 15 thus formed, recesses 152 and 153 are covered by second rear cover 16 as shown in the cross section in FIG. 9. Because recesses 152 and 153 are positioned opposite piezoelectric element 58 with thin wall 155 disposed therebetween, recesses 152 and 153 covered by second rear cover 16 form resonance chamber 100 for the sound emitted by piezoelectric element 58. Because recesses 152 and 153 also extend to outside edge 159 in the nine o'clock direction on the back of first rear cover 15, recesses 152 and 153 form first sound hole 102 open to the outside between outside edge 159 of first rear cover 15 and outside edge 269 of second rear cover 16. When second rear cover 16 covers first rear cover 15, recesses 152 and 153 also form a second sound hole 103 open to the outside from hole 261 in second rear cover 16.

Vibrations from piezoelectric element 58 are thus transmitted through thin wall 155 to resonance chamber 100 and amplified therein, and are emitted from first sound hole 102. Note that first rear cover 15 and second rear cover 16 are in direct contact with each other in the areas in which resonance chamber 100 is not formed, and the strength in these areas is greater than that in the thin wall 155 by an amount equivalent to difference between the thickness of thin wall 155 and the combined thicknesses of the two cover members. More specifically, the strength in these areas is equivalent to the strength of a single stainless steel plate approximately 1.1 mm thick. On the other hand, a gap (i.e., resonance chamber 100) is formed between second rear cover 16 and first rear cover 15 in the area where recesses 152 and 153 are formed. The strength of first rear cover 15 and second rear cover 16 is therefore limited to the strength of these single members in the area of recesses 152 and 153, but this lower strength area is limited to only part of first and second rear covers 15 and 16. As a result, first and second rear covers 15 and 16 both have sufficient strength. It is therefore possible to form resonance chamber 100 while retaining a thin, lightweight device body 10 because it is not necessary to increase the thickness of first and second rear covers 15 and 16.

The combined thickness of first and second rear covers 15 and 16 is also the simple sum of the separate thicknesses, or approximately 1.1 mm, because first and second rear covers 15 and 16 are placed in direct mutual contact rather than with a specific gap maintained therebetween. As a result, the thickness of device body 10 can be reduced.

The thickness of the member separating piezoelectric element 58 from resonance chamber 100 (i.e., thin wall 155) is also a thin 0.4 mm approximately because recesses 152 and 153 are formed in first rear cover 15 rather than in second rear cover 16. Vibrations from piezoelectric element 58 are therefore efficiently transmitted to resonance chamber 100, and a large alarm noise can be emitted.

Note again that recesses 152 and 153 are separated by reinforcing rib 154, which reinforces that part of first rear cover 15 in which recesses 152 and 153 are formed, and supports second rear cover 16. As a result, reinforcing rib 154 increases the strength of first and second rear covers 15 and 16 compared with a resonance chamber construction in which no reinforcing rib is provided. This also makes it possible to minimize the thickness of first and second rear covers 15 and 16.

Turning to FIG. 9, the first sound hole 102 is also not blocked by the skin when device body 10 is worn on the wrist because recesses 152 and 153 are open to the outside through first sound hole 102 formed between outside edge 159 of first rear cover 15 and outside edge 269 of second rear cover 16. In addition, any water that may enter resonance chamber 100 from first sound hole 102 can be easily drained from first sound hole 102 by tilting or shaking device body 10 because first sound hole 102 is open to the air at the side of device body 10 and second sound hole 103 is also open.

Structure stopping the device body from rotating around the wrist

Figure 10:
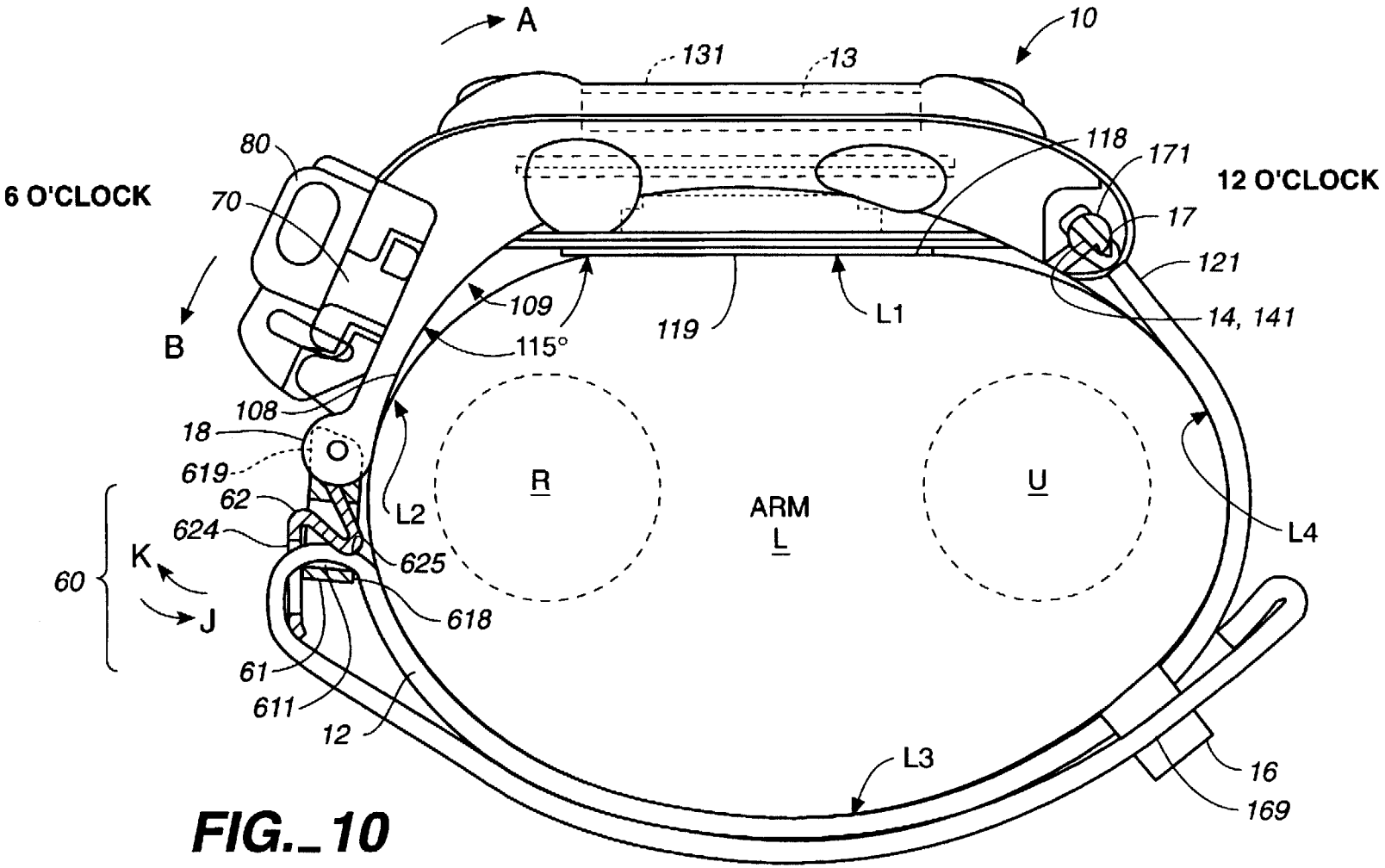
FIG. 10 is a diagram showing the device body of the wristwatch type pulse wave measuring device shown in FIG. 1A taken from the three o'clock direction of a wristwatch.

FIG. 10 is a descriptive diagram showing the device body of the wristwatch type pulse wave measuring device of the present embodiment viewed from the three o'clock position.

Referring to FIG. 10, a connecting member 17 for holding the band holding pin 14 attached to the end 121 of wrist band 12 is formed on the outside of watch case 11 at the twelve o'clock position. A holder 18 is formed on the outside of watch case 11 at the six o'clock position, and a band fastener 60 is attached to the holder 18; wrist band 12 is wrapped around the wrist and folded back around fastener 60 at some intermediate lengthwise position, and held by fastener 60.

Turning stop 108 forming an approximately 115° angle to back 119 is formed integrally to watch case 11 extending from the edge of flat back 119 to holder 18 at the six o'clock position of device body 10. As a result, when pulse wave information measuring apparatus 1 is worn and held on the top L1 (the same side as the back of the hand) of the left wrist L (arm), back 119 of watch case 11 is tight against top L1 of wrist L, and turning stop 108 is touching side L2 on the same side of the arm as the radius R. In this position, back 119 of device body 10 straddles the radius R and ulna U of the arm, and the curved part 109 between turning stop 108 and back 119 is pressed against the radius R of the arm. Because turning stop 108 and back 119 form an anatomically ideal angle of approximately 115°, attempts to turn device body 10 in the direction of arrow A, i.e., around the wrist from the front (radius) to the back (ulna), are stopped with turning stop 108 contacting side L2 of wrist L, and device body 10 will not turn further. Similar efforts to turn device body 10 in the direction of arrow B, i.e., around wrist L to the front, are also stopped with back 119 of device body 10 contacting top L1 of wrist L, and device body 10 will not move further.

Furthermore, because device body 10 does not completely contact the entire circumference of the wrist L and there is a partial gap to the surface of the wrist L, wearing comfort is not impaired by providing turning stop 108. Note that rotation around the wrist is prevented at only two places on one side by back 119 and turning stop 108. As a result, rotation is effectively prevented even when the arm is thin because back 119 and turning stop 108 reliably contact the arm, and there is no constricted feeling when the arm is thick.

It should also be noted that it has been confirmed that rotation of device body 10 around the arm can be reliably prevented if the angle formed by back 119 and turning stop 108 is between approximately 105° to approximately 125°. It should also be noted that wristwatch-type pulse wave measuring device 1 may be worn with device body 10 positioned at the bottom L3 (the same side as the palm) of the wrist L, in which case turning stop 108 of device body 10 is positioned in contact with side L4 on the same side as the ulna U. Even in this position, device body 10 will not rotate unnecessarily whether force is applied in the direction of arrow A or arrow B.

Structure for holding the wrist band

FIG. 11A is a plan view of the wrist band used in the wristwatch type pulse wave measuring device of the present embodiment, FIG. 11B is an end view of the band holding pin attached to the end of the wrist band, and FIG. 11C is a cross-sectional view of the band fastener for the band holding pin. FIG. 12A is a plan view of the band fastener, and FIG. 12B is a side cross-sectional view of the band fastener.

As shown in FIG. 11A, band holding pin 14 is fastened to end 121 of wrist band 12. As shown in FIG. 11B, band holding pin 14 is a flat stud of which both ends 141 are inserted to hole 171 formed in connecting member 17 of device body 10.

As also shown in FIG. 11C, guide channel 172 for inserting and removing band holding pin 14 is formed in connecting member 17 of device body 10 from hole 171 to an opening at the back side of device body 10. The width of the opening to guide channel 172 is narrower than the width W of band holding pin 14 and greater than the thickness Y of ends 141.

A ledge 173 preventing ends 141 of band holding pin 14 inside hole 171 from slipping out from guide channel 172 is formed at the transition between guide channel 172 and hole 171 projecting from one side wall toward the inside of hole 171. The width of the opening at this ledge 173 is greater than the thickness of band holding pin 14 but narrower than the width W of band holding pin 14, and thus prevents band holding pin 14 from slipping out of hole 171. As shown by dot-dash line S in FIG. 11C, ends 141 can be inserted through guide channel 172 into hole 171 by holding ends 141 of band holding pin 14 sideways and sliding ends 141 in the direction of arrow Z1 through guide channel 172. Note that the width H of hole 171 between the inside edge of ledge 173 and the opposing wall is less than the width W of band holding pin 14. As a result, when band holding pin 14 is rotated in the direction of arrow Z2 after ends 141 are inserted to hole 171, ends 141 catch on ledge 173 and stop rotating when in the approximate position shown by dot-dash line T. Ends 141 thus remain held by ledge 173, and band holding pin 14 cannot accidentally slide out from hole 171.

Wrist band 12 fastened at the twelve o'clock position of device body 10 is thus wrapped around the wrist and folded back over itself at the six o'clock position to hold device body 10 on the wrist as shown in FIG. 10.

More specifically, band fastener 60 is disposed to holder 18 at the six o'clock position of device body 10, and wrist band 12 is wrapped around the wrist and folded back over itself over band fastener 60, which holds wrist band 12 at the fold. A pair of holes 181 are formed in the side of device body 10 for holder 18, and the ends of the band fastening stud 182 holding band fastener 60 are inserted to these holes 181.

As shown in FIGS. 12A and 12B, band fastener 60 comprises buckle frame 61 (shown by the double dot-dash line) and buckle presser 62. Buckle frame 61 comprises a band path 611 through which wrist band 12 is passed from bottom to top. Buckle presser 62 rotates on band fastening stud 182 to cover buckle frame 61. Buckle frame 61 is made from a roughly U-shaped metal plate shaped to form band path 611 on the inside thereof. Buckle frame 61 can rotate within a specific arc on band fastening stud 182 by passing band fastening stud 182 through hole 612 formed in the base end of buckle frame 61. Two anti-slip nubs 617 preventing wrist band 12 from slipping are formed on buckle frame 61 on the inside surface 616 of band path 611.

Slit 624 through which wrist band 12 is passed is formed in buckle presser 62. The base of buckle presser 62 is processed to form ring 621. Band fastening stud 182 is passed through ring 621 to fasten buckle presser 62 to device body 10 in a manner enabling buckle presser 62 to rotate on band fastening stud 182. Band presser 625 is formed by the angular parts bent to a Z shape at the underside of buckle presser 62.

Figure 13:
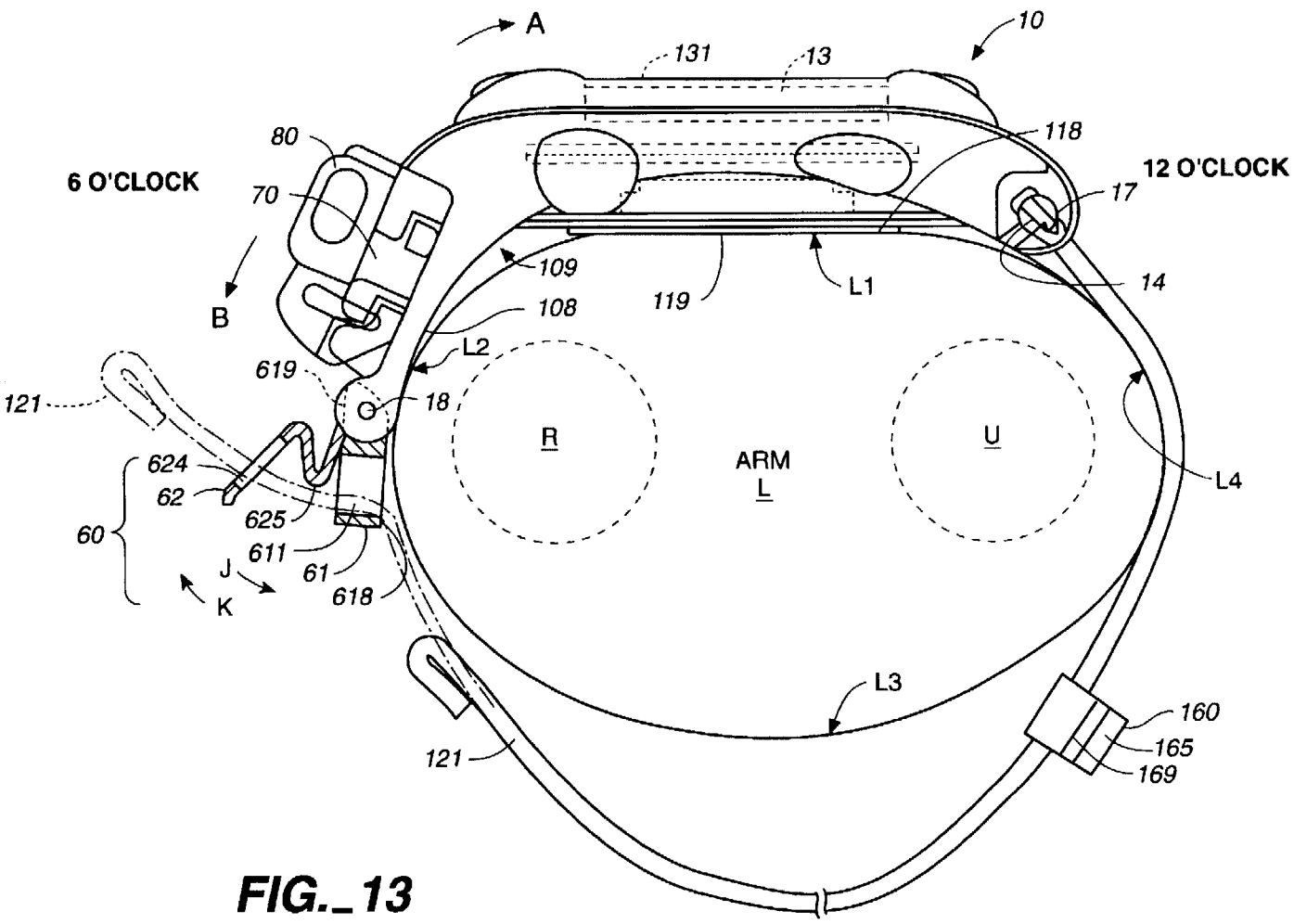
FIG. 13 is a diagram of the operation tightening the wrist band in the wristwatch type pulse wave measuring device shown in FIG. 1A.

While buckle presser 62 can rotate on band fastening stud 182 in the directions of both arrows J and K, buckle frame 61 is blocked from rotating further in the direction of arrow K by interference between stopper 619 at the base of buckle frame 61 and the edge of device body 10. Band presser 625 can therefore be removed from band path 611 in buckle frame 61 if buckle presser 62 is separated from buckle frame 61 by rotating only buckle presser 62 in the direction of arrow K as shown in FIG. 13. This permits band end 121 to be passed easily through band path 611 and slit 624 as shown by the dotted line in FIG. 13.

If end 121 is then released from this position, a force pulling back towards end 121 acts on wrist band 12. Friction between band presser 625 and wrist band 12 at this time causes buckle presser 62 to rotate back in the direction of arrow J. As a result, band presser 625 moves inside band path 611, and holds wrist band 12 inside band path 611. Wrist band 12 is thus held firmly between band presser 625 and bottom edge 618 of band path 611, and the friction between wrist band 12 and buckle frame 61 is great. As a result, wrist band 12 will not loosen further. Wrist band 12 is also held firmly and will not loosen because anti-slip nubs 617 are formed on the inside of band path 611 opposing band presser 625.

The free end 121 of the wrist band folded back on itself is then held by band clip 160. Band clip 160 is shaped by bending a single thin metal plate as shown in FIGS. 14A and 14B, and holds wrist band 12 at a specific position by slipping wrist band 12 through gap 163 between base 162 and middle member 161. An anti-slip nub 164 is also formed facing into gap 163 to prevent band clip 160 from slipping unintentionally along wrist band 12. End 165 of band clip 160 is acutely bent to function as a leaf spring holding free end 121 of wrist band 12 in the gap 169 between end 165 and middle member 161. Note that a slit 167 is formed in end 165 for strength and aesthetics.

By using a freely adjustable band fastener 60 as thus described, device body 10 according to the present embodiment can be held firmly and reliably to the arm. It is also convenient to use because there is only a single part to wrist band 12. Wrist band 12 can also be operated close to device body 10 because it is wrapped around the wrist from the twelve o'clock position of device body 10 to the six o'clock position. It is therefore possible to tighten wrist band 12 on the wrist while holding device body 10 on top of the left wrist using just the right hand, and device body 10 can be put on reliably and with little trouble.

Sensor unit configuration

Figure 15A:
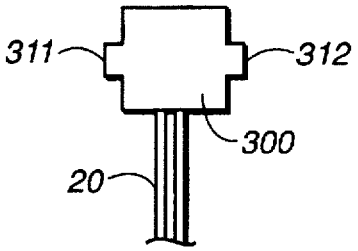
FIG. 15A is a plan view of the optical unit of a sensor unit used in the wristwatch type pulse wave measuring device shown in FIG. 1A.
Figure 15B:
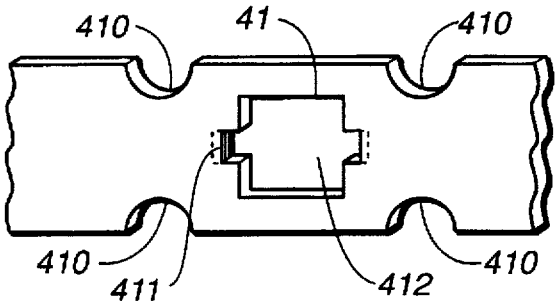
FIG. 15B is a plan view showing a sensor fastening band of the sensor unit used in this wristwatch type pulse wave measuring device shown in the opened position.
Figure 15C:
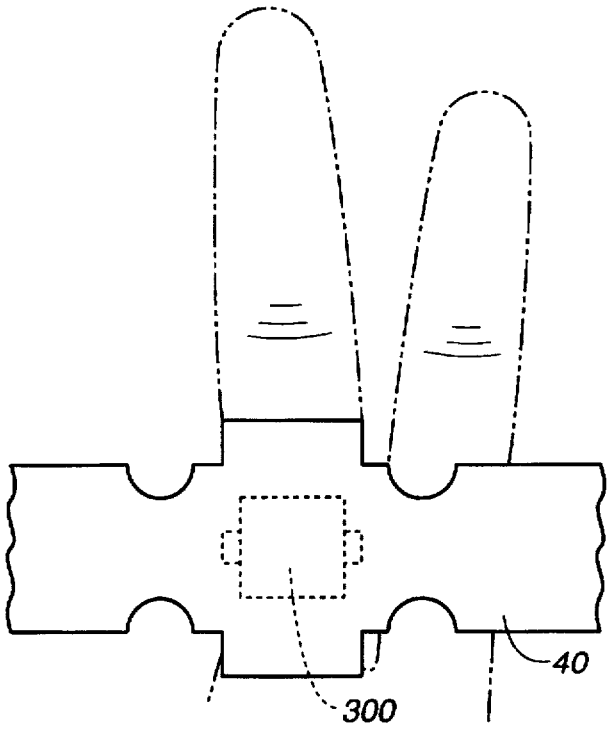
FIG. 15C is a diagram showing the structure of a sensor unit positioned on a finger.
Figure 16:
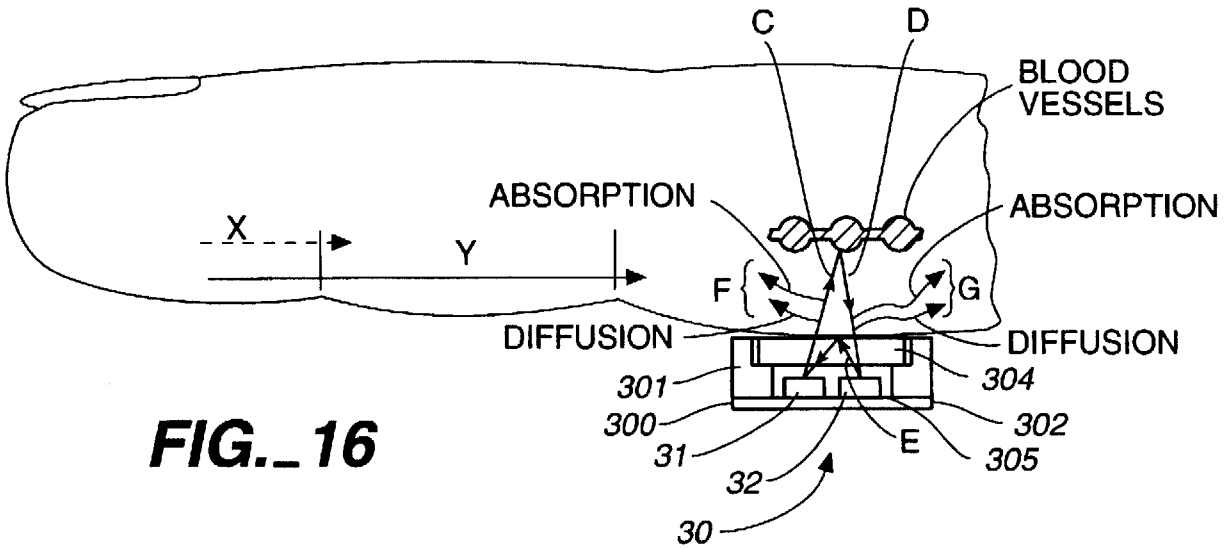
FIG. 16 shows the sensor unit of the wristwatch type pulse wave measuring device shown in FIG. 1A attached to the finger.

FIG. 15A is a plan view of the optical sensor unit of the sensor unit used in the wristwatch-type pulse wave measuring device according to the present embodiment, FIG. 15B is a plan view showing the band for securing the sensor of the sensor unit used in this wristwatch-type pulse wave measuring device when the band is laid flat, FIG. 15C shows the structure of an alternative sensor unit, and FIG. 16 is a descriptive diagram showing the sensor unit when worn at the base of the finger.

Referring again to FIG. 1B, sensor unit 30 comprises sensor securing band 40 and optical sensor unit 300. Sensor securing band 40 is made from a flexible, thick resin molding which is spread open from a normally circular configuration, fit over the base of the finger, and then released, allowing the inherent shape retention of the band to wrap the band around the base of the finger. The middle part of sensor securing band 40 is thicker than the rest of the band, and comprises a hole 41 for holding optical sensor unit 300 therein.

Referring specifically to FIG. 15A, optical sensor unit 300 is enclosed in a rectangular resin molding comprising a pair of flanges 311 and 312 on the side with cable 20 leading from the inside of this optical sensor unit 300.

In FIG. 15B, hole 41 in sensor securing band 40 is a shape and size allowing optical sensor unit 300 to be embedded therein, and comprises recesses 411 and 412, in which flanges 311 and 312 are fit when optical sensor unit 300 is fit in hole 41, to prevent optical sensor unit 300 from falling out. Note also that constricted parts 410 are formed in four places in sensor securing band 40 to enable easier fitting to the finger.

Because it is sufficient to be able to lightly clench the hand when the sensor unit 30 is worn at the base of the finger, there is no problem if the width of sensor securing band 40 is approximately 20 mm. A configuration in which the width of sensor securing band 40 is slightly wider in the part where optical sensor unit 300 is held can also be used as shown in FIG. 15C. Because optical sensor unit 300 is also worn on the finger, an opaque athletic support-like band can also be used.

Referring to FIG. 16, optical sensor unit 300 comprises a sensor frame 301 as the case closed by bottom cover 302, thus forming a parts housing on the inside. Glass plate 304 (filter) forms a transparent window in the top of sensor frame 301, and circuit board 305 is secured inside sensor frame 301 opposing this glass plate 304. Light emitting diode or LED 31, phototransistor 32, transistors (not shown), and other electronic components are mounted on circuit board 305 with LED 31 and phototransistor 32 oriented with the light emitting face and receptor face, respectively, facing glass plate 304.

In this embodiment an InGaN (indium-gallium-nitrogen) blue LED is preferably used for LED 31; the emissions spectrum of this LED has an emissions peak at 450 nm and an emissions wavelength ranging from 350 nm to 600 nm. Corresponding to the emissions characteristics of LED 31, a GaAsP (gallium-arsenic-phosphorus) phototransistor is used as phototransistor 32 in this embodiment; the detection range of this element has a primary sensitivity range from 300 nm to 600 nm with sensitivity also extending below 300 nm. It is also possible to use a sensor unit adding a filter to this element as phototransistor 32, in which case the primary detection wavelength ranges from 400 nm to 550 nm.

When light is emitted toward the finger from LED 31, part of the light travels through the finger and reaches the blood vessels as shown by arrow C, and the light reflected from hemoglobin in the blood travels back to phototransistor 32 as shown by arrow D. The light detected through this path is referred to as the "bioreflectance" below. Part of the light emitted from LED 31 is also reflected at the finger surface as shown by arrow E, and travels back to phototransistor 32. The light detected through this path is referred to as the "surface reflectance" below. Part of the light emitted from LED 31, and part of the light reflected from the blood vessels, is absorbed or diffused inside the finger as shown by arrows F and G, and does not reach phototransistor 32.

When light is emitted from LED 31 toward the finger in optical sensor unit 300 thus comprised, the light reflected from the body (blood vessels) is detected by phototransistor 32, the detection result (pulse signal) is output by optical sensor unit 300 to device body 10 through cable 20, and the pulse count or other pulse information obtained from this pulse signal is displayed by device body 10.

Data processing circuit configuration

Figure 17:
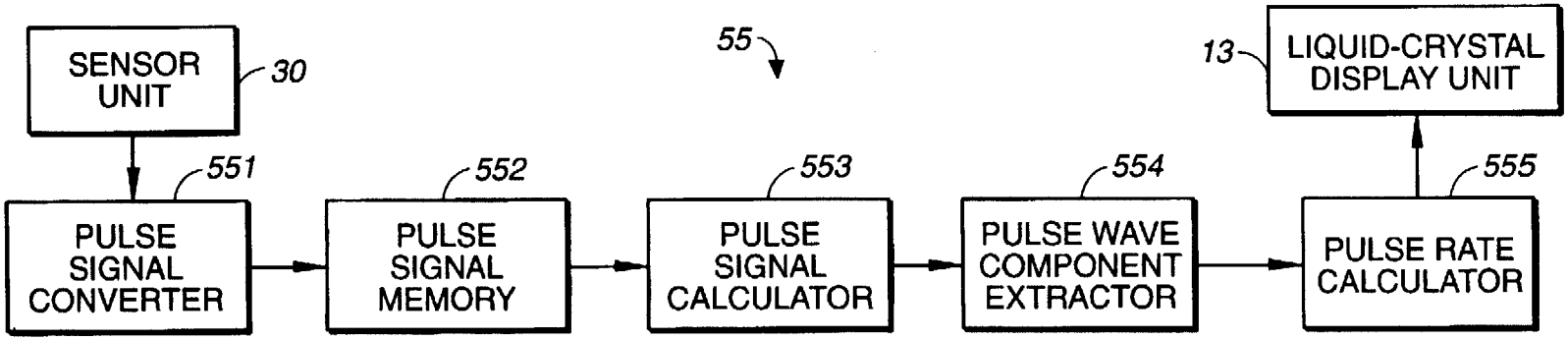
FIG. 17 is a functional block diagram showing a data processing circuit of the wristwatch type pulse wave measuring device shown in FIG. 1A.

FIG. 17 is a functional block diagram of the data processing circuit. As shown in FIG. 17, the pulse signal converter 551 of data processor 55 comprised in IC 50 of controller 5 converts the signal input from sensor unit 30 through cable 20 to a digital signal, and then outputs to pulse signal memory 552. Pulse signal memory 552 is preferably a random access memory or RAM, for storing the pulse data converted to digital signals.

Pulse signal calculator 553 reads and performs frequency analysis of the signal stored in pulse signal memory 552, and inputs the result to pulse component extractor 554. Pulse component extractor 554 extracts the pulse component from the input signal from pulse signal calculator 553, and outputs to pulse rate calculator 555. Pulse rate calculator 555 calculates the pulse count based on the input pulse wave frequency component, and outputs the result to LCD unit 13.

Connector means configuration

Figure 18:
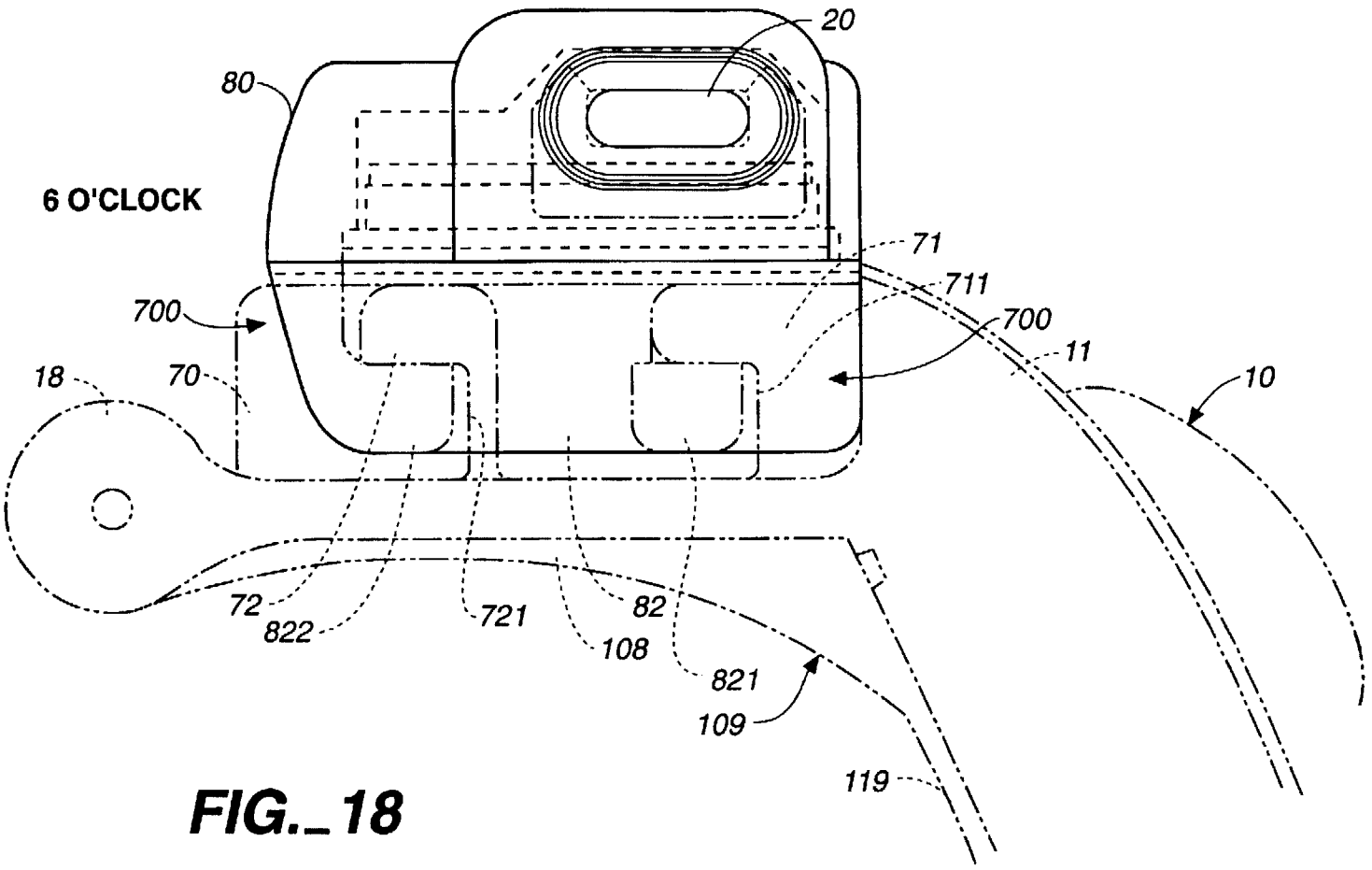
FIG. 18 is an enlarged view of a connector of the wristwatch type pulse wave measuring device shown in FIG. 1A seen from the direction of three o'clock on a wristwatch.
Figure 19:
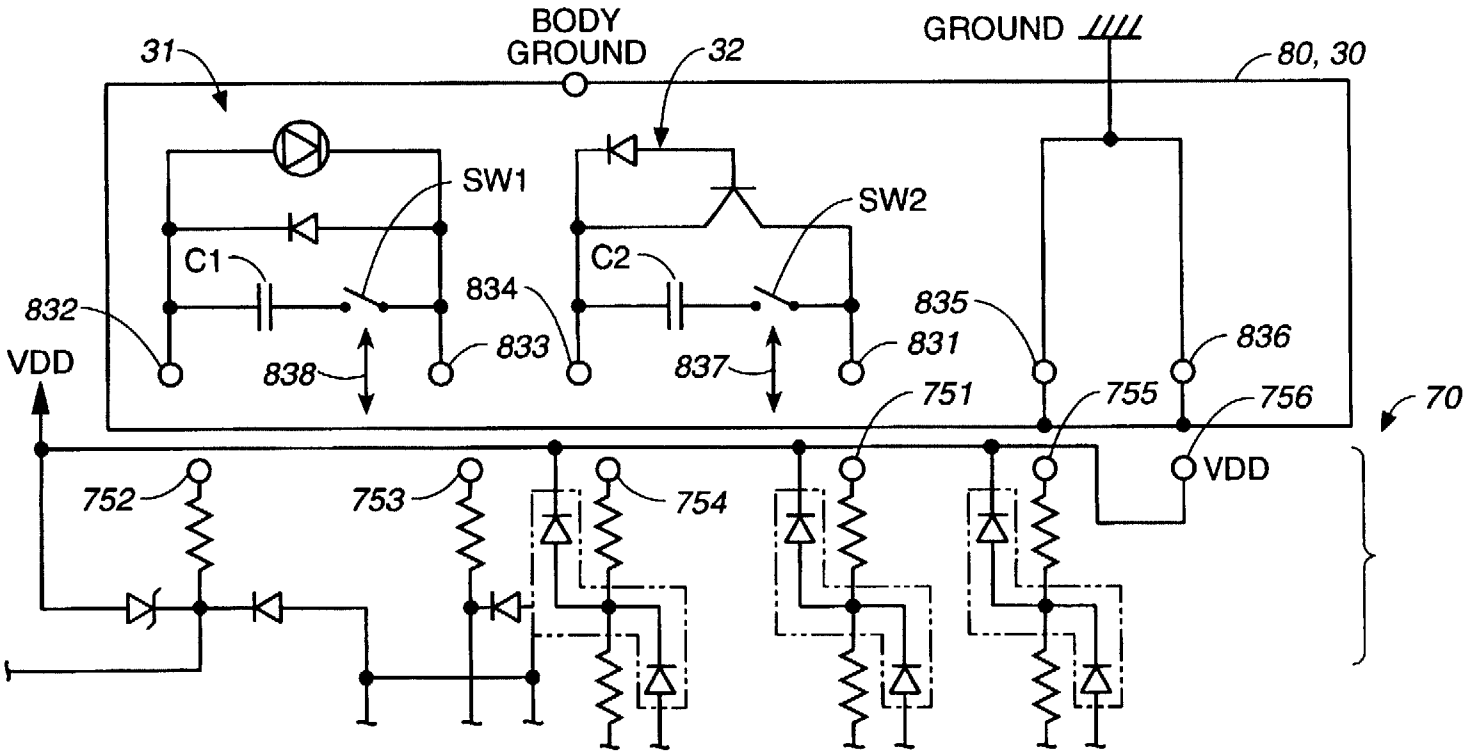
FIG. 19 is a schematic diagram of the electrical connections in the connector of the wristwatch type pulse wave measuring device shown in FIG. 1A.

FIG. 18 is an enlarged view position of the connector piece fit to the connector member from the three o'clock. FIG. 19 is a schematic diagram which illustrates connecting the sensor circuit electrodes on the connector piece side with the terminals of the connector member for communicating signals with the sensor circuit.

So that wristwatch-type pulse wave measuring device 1 according to the present embodiment can be used as a common wristwatch when not measuring pulse waves, cable 20 and sensor unit 30 can be connected and disconnected at the side of device body 10 positioned near six o'clock as shown in FIG. 1A. More specifically, a connector 70 is formed on the outside surface of the part extended as turning stop 108 at the six o'clock position on the edge of device body 10 such that connector piece 80 (connector member for pulse signal input) disposed on the end of cable 20 can be fit thereto as shown in FIG. 18. Wristwatch-type pulse wave measuring device 1 can therefore be used as a common wristwatch if sensor unit 30 and cable 20 are disconnected from device body 10.

Furthermore, because connector 70 is formed on the surface of the part corresponding to turning stop 108, the part extended to provide turning stop 108 can be used for connector 70. Connector 70 is also on the front when seen by the user with device body 10 worn on the arm because connector 70 is positioned near the six o'clock position, and operation is therefore simple. The user can also freely bend the wrist while running, and the back of the hand will not strike connector 70 even if the user falls while running, because connector 70 does not project at the three o'clock position from device body 10.

The electrical connections completed between connector 70 and connector piece 80 (connector means) are as shown in FIG. 19.

Referring to FIG. 19, terminals 751–756 (first terminal group) are disposed to connector 70, which is provided on the device body 10 side, and electrodes 831–836 (second terminal group) corresponding to these terminals 751–756 are disposed to connector piece 80. Terminal 752 is a positive terminal for supplying second drive voltage VDD to LED 31 through electrode 832; terminal 753 is a terminal set to the negative potential of LED 31 through electrode 833; terminal 754 is for supplying the constant drive voltage VREG to the collector terminal of phototransistor 32 through electrode 834; terminal 751 is the terminal to which the signal from the emitter terminal of phototransistor 32 is input through electrode 831; and terminal 755 is the terminal to which is input through electrode 835 the signal for detecting whether connector piece 80 is connected to connector 70. Electrode 836 grounds sensor unit 30 to the body, and shields electrodes 831–836 by making VDD the ground when terminal 756 and electrode 836 are electrically connected.

A first capacitor C1 and first switch SW1 are inserted between the LED 31 terminals (between electrodes 832 and 833) in connector piece 80. This switch SW1 is closed when connector piece 80 is disconnected from connector 70, connecting first capacitor C1 parallel to LED 31, and is open when connector piece 80 is connected to connector 70. A second capacitor C2 and second switch SW2 are similarly inserted between the terminals (electrodes 831 and 834) of phototransistor 32. This switch SW2 is closed when connector piece 80 is disconnected from connector 70, connecting the second capacitor C2 parallel to phototransistor 32, and is open when connector piece 80 is connected to connector 70.

The structure of connector piece 80 and connector 70 is described further below with reference to FIGS. 20A–23.

Figure 20A:
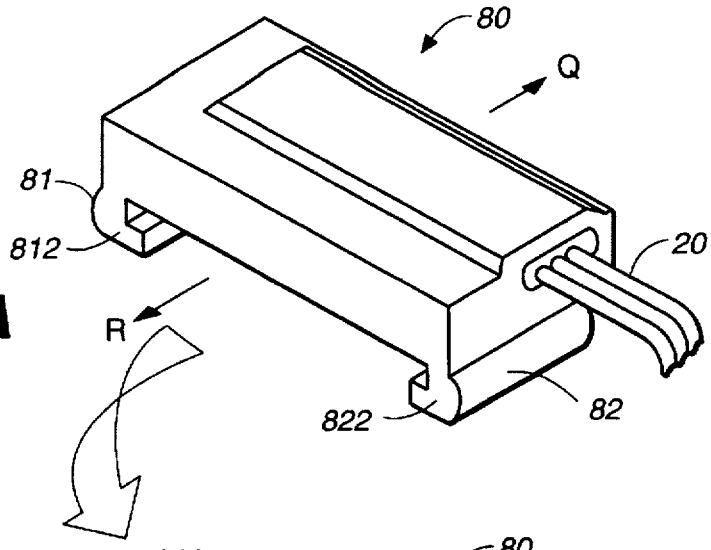
FIGS. 20A and B show the structure of a connector piece used with the connector shown in FIG. 18.
Figure 21:
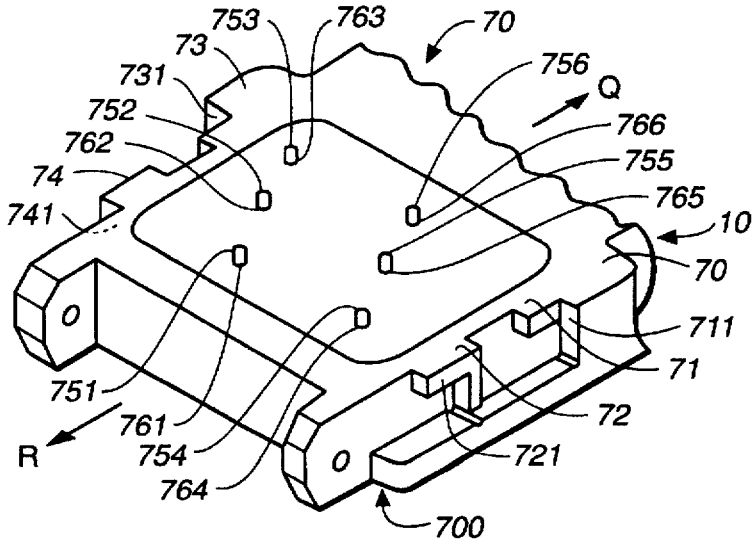
FIG. 21 shows the connector shown in FIG. 18.
Figure 22:
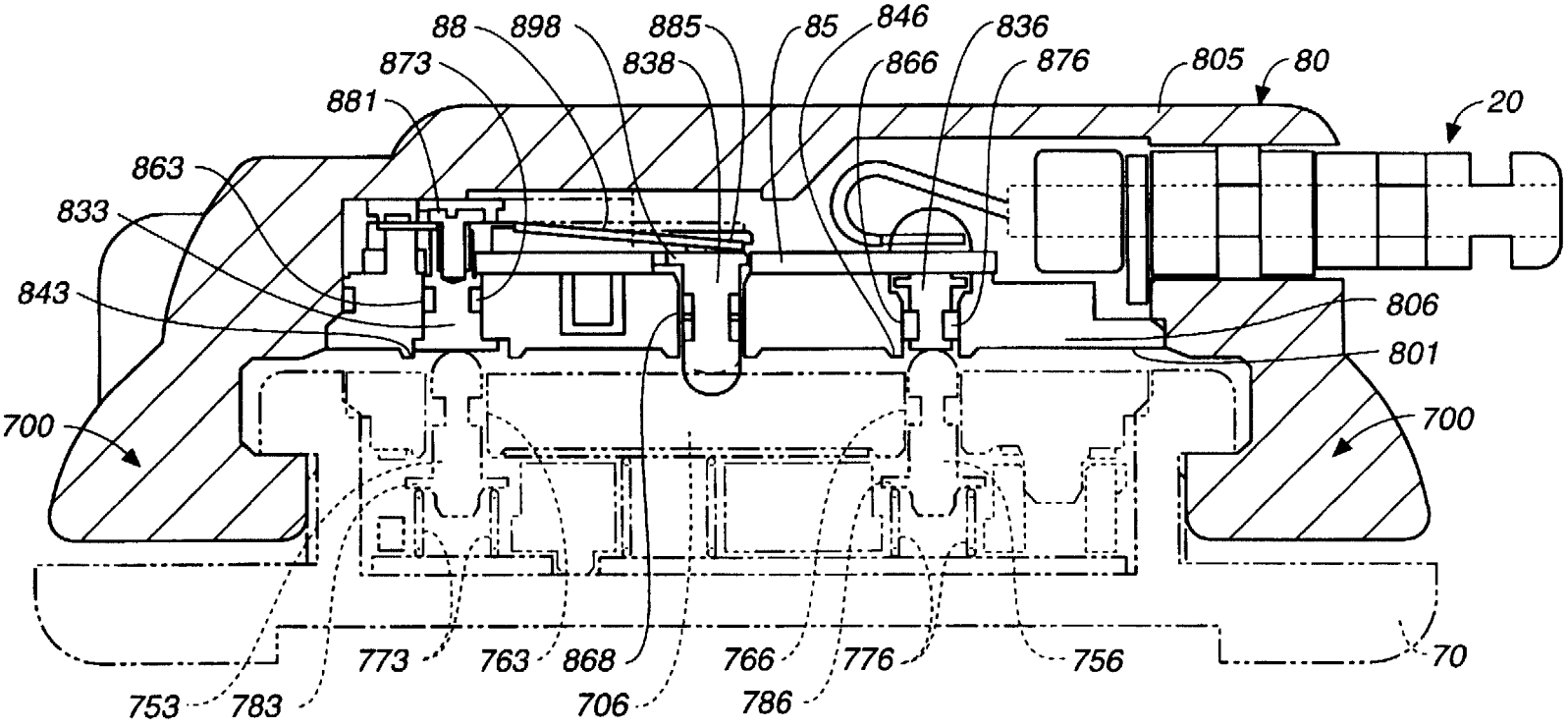
FIG. 22 is a cross-sectional view of the connector piece shown in FIG. 20A attached with the connector shown in FIG. 21.
Figure 23:
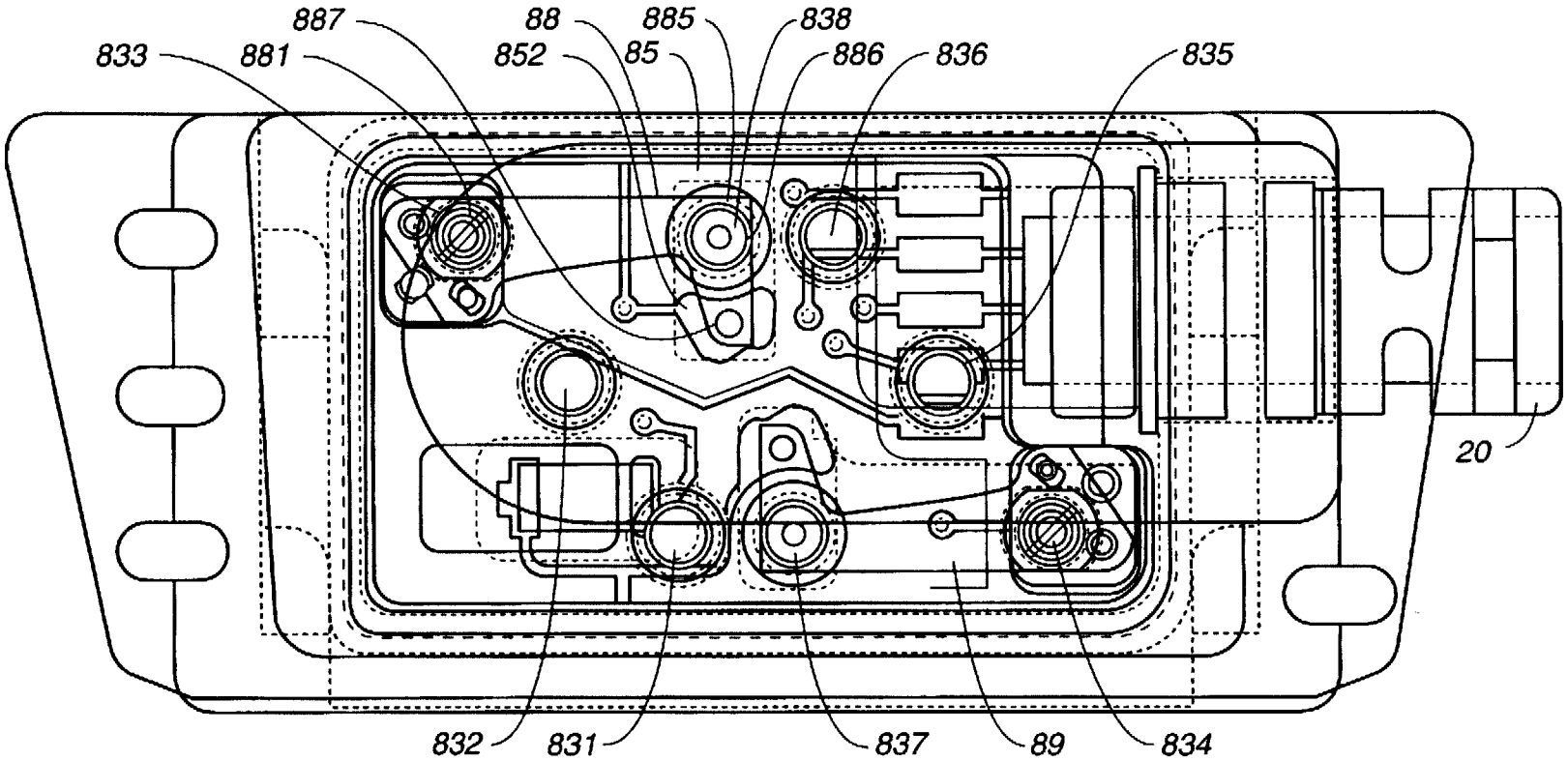
FIG. 23 is a plan view showing the positions of the electrodes in the connector piece shown in FIG. 20.

FIGS. 20A and B are enlarged views showing the construction of the connector piece disposed at the end of the cable, FIG. 21 is an enlarged view of the connector on the device body, FIG. 22 is a vertical cross-sectional view showing the connector piece connected to the connector, and FIG. 23 is used to describe the circuit pattern and placement of the electrodes in the connector piece.

Figure 20B:
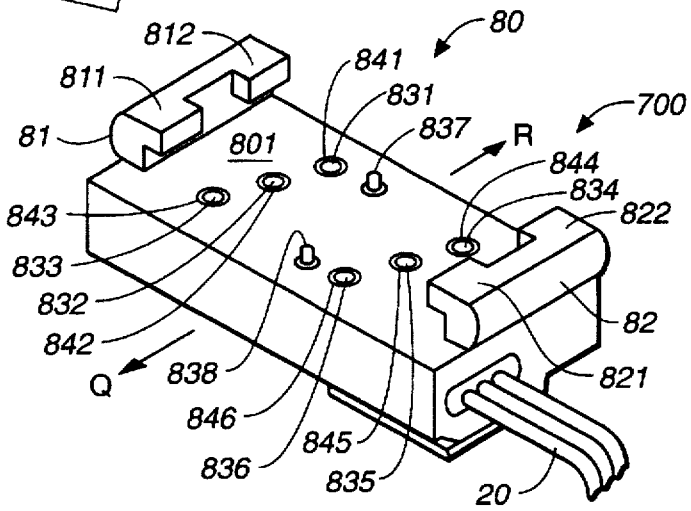

Referring to FIG. 20, a pair of projections 81 and 82 projecting downward is formed on both sides of the bottom 801 of connector piece 80. Four engaging members 811, 812, 821, and 822 (second group of engaging claws) project toward the inside at the bottoms of these projections 81 and 82.

Six electrodes 831, 832, 833, 834, 835, 836 (second terminal group) are formed on the bottom 801 of connector piece 80, and annular ridge members 841, 842, 843, 844, 845, and 846 are formed around each electrode. Connector piece 80 is thus positioned over connector 70 and then slid in the direction of arrow Q to mount connector piece 80 on connector 70 with electrodes 831–836 formed in two rows of electrodes 831, 833, and 833, and electrodes 834, 835, and 836 in this sliding direction (the direction of arrow Q). In addition, the electrodes 831–836 in each row are arranged at an angle offset in a direction intersecting the sliding direction (direction of arrow Q) of connector piece 80.

Two operating pins 837 and 838 for switching a circuit blocking the effects of static electricity when cable 20 is connected to device body 10 are also provided on the bottom of connector piece 80. The ends of these operating pins 837 and 838 project from bottom 801 of connector piece 80 when connector piece 80 is removed from connector 70.

As shown in FIG. 21, engaging parts 71, 72, 73, and 74 (first group of engaging claws) projecting to the outside are formed on connector 70. Therefore, if, after fitting connector piece 80 down over connector 70 such that projections 81 and between terminals and between electrodes does not easily occur even if water penetrates between connector piece 80 and connector 70. Furthermore, tracking between different-potential terminals and electrodes does not occur because terminals 752, 754, and 756, and electrodes 832, 834, and 836 to which the drive voltage is applied are specifically arrayed at separated positions.

When connector piece 80 is disconnected from connector 70, connector piece 80 is slid in the opposite direction in the direction of arrow R. As a result, engaging members 811, 821 return to the positions between engaging parts 71 and 72 and engaging parts 73 and 74. Connector piece 80 can therefore be easily and reliably removed from connector 70 by simply lifting connector piece 80 up.

Engaging mechanism 700 is thus comprised such that connector piece 80 is engaged when connector piece 80 is slid across connector 70 in the direction of arrow Q, and this engaged state is released when connector piece 80 is slid from this state in the opposite direction (the direction of arrow R).

Furthermore, when connector piece 80 is slid from six o'clock in the direction of twelve o'clock on connector 70, the force applied to device body 10 is applied in the direction whereby rotation of device body 10 is made difficult by turning stop 108. Because device body 10 therefore does not turn around the wrist even when connector piece 80 is mounted, mounting is simple.

Stopper mechanism construction

As will be known from FIG. 21, vertical faces 711, 721, 731, and 741 are formed on engaging parts 71–74 on the side in the direction of arrow Q. Therefore, if connector piece 80 is slid in the direction of arrow Q (second operation) when mounting connector piece 80 on connector 70, engaging members 811, 812, 821, and 822 respectively contact vertical faces 711, 721, 731, and 741, thus stopping connector piece 80 in the mounted position on connector 70. The vertical faces 711, 721, 731, and 741 therefore function as a first stopper for connector piece 80.

Conversely, when connector piece 80 is slid in the direction of arrow R for removal from connector 70, engaging members 811, 821 contact the backs of vertical faces 721 and 741 of engaging parts 72 and 74, thus stopping connector piece 80 in 82 of connector piece 80 are positioned outside engaging parts 71, 72, 73, and 74 of connector 70, and engaging members 811 and 821 of connector piece 80 are positioned between engaging parts 71 and 72 and engaging parts 73 and 74, respectively, connector piece 80 is pushed towards connector 70 such that engaging members 811 and 821 pass between engaging parts 71 and 72 and engaging parts 73 and 74, respectively, (the first operation for connecting connector piece 80 to connector 70), and connector piece 80 is then slid in the direction of arrow Q (the mounting direction for connector piece 80, the direction from six o'clock to twelve o'clock of device body 10), engaging members 811, 821 become seated below engaging parts 71 and 73. Engaging members 812 and 822 are also seated below engaging parts 72 and 74.

As a result, engaging members 811, 821, 812, and 822 hold engaging parts 71, 72, 73, and 74 between engaging members 811, 821, 812, and 822 and bottom 801 of connector piece 80, and connector piece 80 can be easily and reliably connected to connector 70.

It should also be noted that terminals 751–756, like electrodes 831–836, are formed in two rows of terminals 751, 752, and 753 and terminals 754, 755, and 756 in the sliding direction of connector piece 80 (the direction of arrow Q). Each of these rows of terminals 751–756 is, like electrodes 831–836, arranged at an angle offset in a direction intersecting the sliding direction (direction of arrow Q) of connector piece 80. Therefore, when connector piece 80 is mounted on connector 70, the six terminals 751–756 are electrically connected to the six electrodes 831–836, respectively, and the measurement result from sensor unit 30 can be input to device body 10 through cable 20.

It should be noted that because terminals 751–756 and electrodes 831–836 are arrayed in two rows in the sliding direction of connector piece 80, and the positions between each of the terminals and each of the electrodes are diagonally offset in a direction intersecting this sliding direction, non-corresponding terminals 751–756 and electrodes 831–836 will not contact even when connector piece 80 is slid across connector 70. Moreover, because the terminals and electrodes can be separated from each other even when the area of connector 70 is confined, shorting the original position on connector 70. The backs of vertical faces 721 and 741 thus function as second stoppers for connector piece 80.

Construction of terminals and electrodes

In connector 70, terminals 751–756 are respectively disposed inside holes 761, 762, 763, 764, 765, and 766 formed in connector 70. A cross-sectional view through where terminals 753 and 756, operating pin 838, and electrodes 833 and 836 are formed is shown in FIG. 22.

As shown in FIG. 22, connector piece 80 is constructed with cover member 806 covering outside case 805 in which circuit board 85 can be housed. Holes 863 and 866 are formed in cover member 806, and annular ridge members 843 and 846 are formed around the open lip at the bottom of the holes. Electrodes 833 and 836 are disposed inside holes 863 and 866. Electrode 833 is secured by screw 881, and electrode 836 is secured between circuit board 85 and cover member 806. A water-resistant packing 873 and 876 is also fit to electrodes 833 and 836. Electrodes 833 and 836 are electrically connected to the circuit pattern of circuit board 85 disposed inside connector piece 80.

This electrode structure is the same for the electrodes other than electrodes 833 and 836, i.e., electrodes 831, 832, 834, and 835. Note that the leads of cable 20 are also electrically connected to the circuit pattern on circuit board 85 by soldering.

Click mechanism configuration

Connector 70 is constructed with the recess therein covered by cover member 706. Holes 763 and 766 are formed in cover member 706. Inside these holes 763 and 766 terminals 753 and 756 are disposed as retractable pins of which the tips project from holes 763 and 766. Coil springs 773 and 776 are disposed to flanges 783 and 786 formed at the base end of each terminal 753 and 756, and terminals 753 and 756 are pushed in the direction protruding from holes 763 and 766 by coil springs 773 and 776. However, because the outside diameter of flanges 783 and 786 is greater than the inside diameter of holes 763 and 766, terminals 753 and 756 will not slip out from holes 763 and 766.

This terminal structure is the same for the terminals other than terminals 753 and 756, i.e., terminals 751, 752, 754, and 755.

Because connector piece 80 is slid over connector 70 when connector piece 80 is mounted to connector 70, terminals 753 and 756 move over annular ridge members 843 and 846 of connector piece 80 while being pushed out by coil springs 773 and 776, and thus positively contact electrodes 833 and 836. Because a click-lock mechanism is thus achieved using annular ridge members 843 and 846, terminals 753 and 756, and coil springs 773 and 776 as thus described, connector piece 80 can be reliably connected to connector 70.

Note that to achieve a click configuration of this type it is also possible to provide terminals using retractable pins on the connector piece 80 side, and provide the annular ridge members on the connector 70, opposite the arrangement of the present embodiment.

Configuration of the switch mechanism preventing damage from electrostatic charges Hole 868 is formed in cover member 806 of connector piece 80, and operating pin 838 is disposed in this hole 868. This operating pin 838 is disposed to be retractable inside hole 868 with the tip thereof projecting from hole 868. A leaf spring type switch spring 88 is disposed to flange 898 formed on the base of operating pin 838. Switch spring 88 pushes operating pin 838 by means of the end 885 thereof in the direction projecting from hole 868. However, because the outside diameter of flange 898 is greater than the inside diameter of hole 868, operating pin 838 will not slip out from hole 868. Switch spring 88 is fastened with the base thereof held by screw 881 to the top of electrode 833, and is thus electrically connected to electrode 833.

In FIG. 20, end 885 of switch spring 88 comprises contact part 886 for contacting the base of operating pin 838, and contact 887 formed on the part extending to the side therefrom. This contact 887 is electrically connected to circuit pattern 852 of circuit board 85. While not shown in the figure, this circuit pattern 852 is inserted between first capacitor C1 and electrode 833.

Therefore, when connector piece 80 is not mounted on connector 70, operating pin 838 is pushed by switch spring 88 and the end projects from hole 868 as shown by the solid line in FIG. 22, and in this state contact 887 of switch spring 88 is electrically connected to circuit pattern 852 of circuit board 85.

More specifically, first switch SW1 closes in conjunction with the movement of operating pin 838 shown by the arrow in FIG. 19, and first capacitor C1 becomes electrically connected parallel to LED 31. As a result, even if a high potential charge caused by static electricity contacts electrodes 832 and 833, the charge is stored to first capacitor C1, and LED 31 is not damaged.

When connector piece 80 is mounted on connector 70, operating pin 838 moves in the direction drawing into hole 868 as shown by the dot-dot-dash line in FIG. 22, and switch spring 88 is deformed as shown by the dot-dot-dash line. When switch spring 88 is thus deformed, contact 887 lifts from circuit pattern 852 of circuit board 85, and the electrical connection is broken.

Specifically, when connector piece 80 is mounted to connector 70, first switch SW1 in FIG. 19 is open, and a circuit configuration capable of measuring the pulse is completed. In addition, even if a charge is stored to first capacitor C1, the charge will not be discharged through electrodes 832 and 833 and terminals 752 and 753, and the circuits contained in connector 70 and device body 10 will not be damaged.

Furthermore, while this switch configuration is simple, it reliably tracks the mounting operation of connector piece 80 to connector 70.

It should also be noted that a switching mechanism of this configuration is also formed for phototransistor 32 as shown in FIG. 19. As will be known from FIG. 23, the configuration of this switching mechanism comprises an operating pin 837 and switch spring 89 similarly to the switching mechanism for LED 31, and further description thereof is therefore omitted below.

Connector cover configuration

Figure 24A:
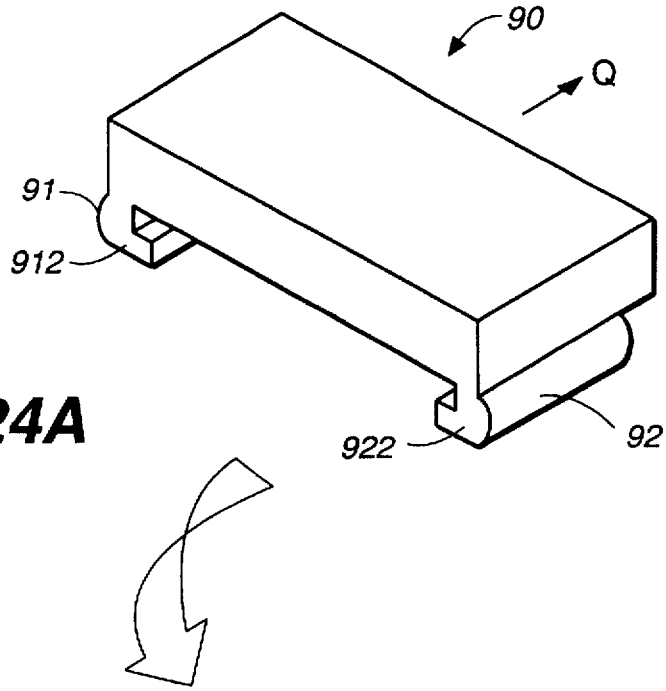
FIGS. 24A and B shows the structure of a connector cover covering the connector and substituted for the connector piece in the wristwatch type pulse wave measuring device shown in FIG. 1A.
Figure 24B:
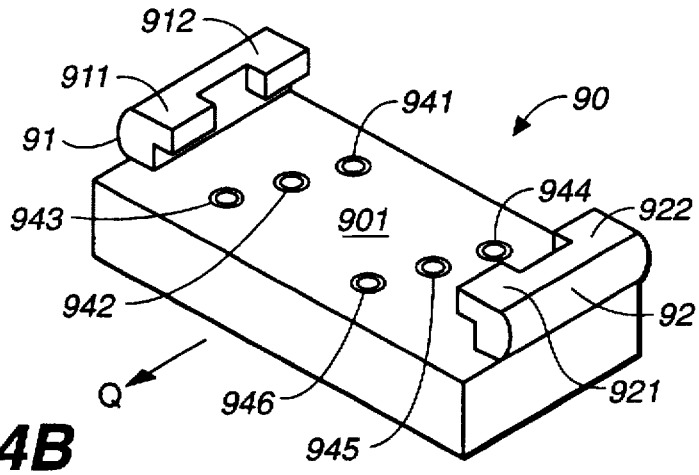
Figure 25:
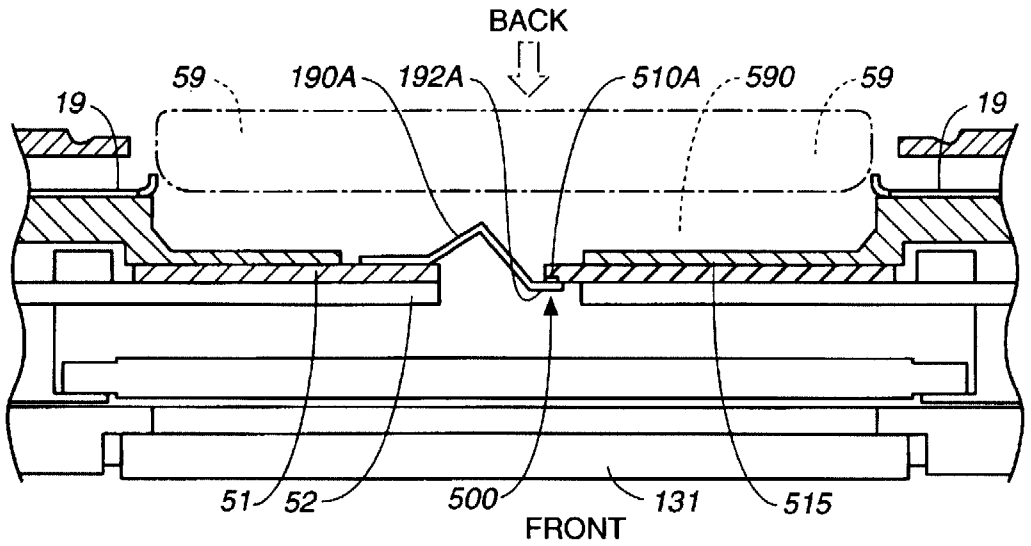
FIG. 25 is a vertical cross-sectional view showing the position of a second switching mechanism for detecting battery presence in the wristwatch type pulse wave measuring device shown in FIG. 1A before the battery is inserted.
Figure 26:
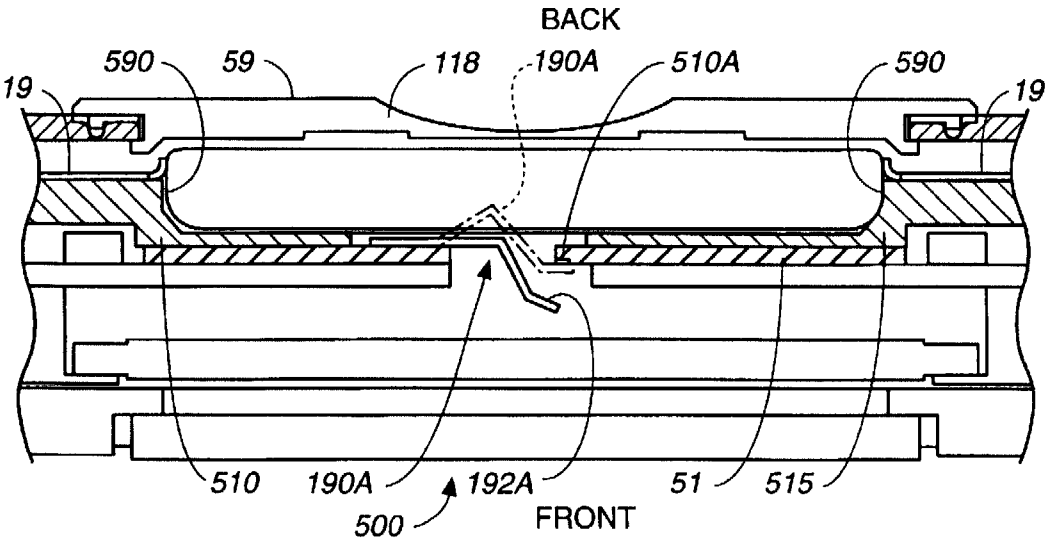
FIG. 26 is a vertical cross-sectional view showing the position of the second switching mechanism for detecting battery presence shown in FIG. 25 after the battery is inserted.

FIGS. 24A and B describe the configuration of connector cover 90, which is mounted to connector 70 in place of connector piece 80 when cable 20 and sensor unit 30 are removed from wristwatch-type pulse wave measuring device 1, and wristwatch-type pulse wave measuring device 1 is used as a regular wristwatch.

Because, unlike connector piece 80, connector cover 90 does not require electrodes, a sensor circuit, and a cable, connector cover 90 is thinner overall and is shaped to not detract from the appearance when mounted to connector 70. However, the structure whereby connector cover 90 is mounted to connector 70 is the same as that of connector piece 80. Specifically, a pair of projections 91 and 92 projecting downward is formed on both sides of the bottom 901 of connector cover 90. Four engaging members 911, 912, 921, and 922 (second group of engaging claws) project toward the inside at the bottoms of these projections 91 and 92. Annular ridge members 941–946 forming a click mechanism with terminals 751 756 are formed on bottom 901 of connector cover 90 at the positions to which terminals 751–756 of connector 70 are disposed.

As with connector piece 80, when connector piece 90 is mounted on connector 70, after fitting connector cover 90 down over connector 70 such that engaging members 911 and 921 of connector cover 90 are positioned between engaging parts 71 and 72 and engaging parts 73 and 74, respectively, connector cover 90 is pushed over connector 70 such that engaging members 911 and 921 pass between engaging parts 71 and 72 and engaging parts 73 and 74, respectively, connector cover 90 is then slid in the direction of arrow Q (the direction from six o'clock to twelve o'clock of device body 10), and engaging members 911, 921 become seated below engaging parts 71 and 73. Engaging members 912 and 922 are also seated below engaging parts 72 and 74.

As a result, engaging members 911, 921, 912, and 922 hold engaging parts 71, 72, 73, and 74 between [engaging members 911, 921, 912, and 922 and] bottom 901 of connector cover 90, and terminals 751–756 of connector 70 ride over annular ridge members 941–946, exhibiting a click force. Connector cover 90 is thus mounted on connector 70.

Overall operation of the wristwatch-type pulse wave measuring device

The operation of wristwatch-type pulse wave measuring device 1 thus comprised is described briefly below.

Referring first to FIG. 1, when wristwatch-type pulse wave measuring device 1 is used as a conventional wristwatch, device body 10 is held on the arm by means of wrist band 12 with cable 20 and sensor unit 30 removed from connector 70 of device body 10. At this time connector cover 90 shown in FIG. 24A is mounted on connector 70, thus improving the appearance and protecting connector 70.

When the pulse rate is measured while running using wristwatch-type pulse wave measuring device 1, connector piece 80 is mounted on connector 70 to connect cable 20 to device body 10, and device body 10 is then secured to the arm using wrist band 12. Sensor unit 30 (glass plate 304 of optical unit 300) is then secured tightly to the finger by sensor securing band 40, and the user goes running.

When light is emitted toward the finger from LED 31 in this state as shown in FIG. 16, the light reaches the blood vessels, part of the light is absorbed by hemoglobin in the blood, and part is reflected. The light reflected from the finger (blood vessels) is detected by phototransistor 32, and the change in detected light quantity corresponds to the blood volume changes resulting from the blood pulse. Specifically, when the blood volume is great, the reflected light is weak; when the blood volume decreases, the reflected light becomes stronger. As a result, the pulse rate, etc., can be detected by monitoring the change in reflected light intensity with phototransistor 32.

To accomplish such detection, the signal input from phototransistor 32 (sensor unit 30) is converted to a digital signal, and the pulse count is calculated by data processor 55 shown in FIG. 17 performing frequency analysis or other analyses on this digital signal. The pulse count obtained from this calculation is then displayed on LCD unit 13. In short, wristwatch-type pulse wave measuring device 1 functions as a pulse wave measuring device.

Sensor unit 30 uses LED 31 with an emissions wavelength range from 350 nm to 600 nm, and phototransistor 32 with a detection wavelength range from 300 nm to 600 nm, and the biological data is expressed based on the detection results in the overlapping wavelength range from approximately 350 nm to approximately 600 nm.

External light with a wavelength of 700 nm or less tends to not pass easily through the finger. Thus, even if the finger area not covered by sensor securing band 40 is exposed to external light, this light does not reach pulse measurement phototransistor 32 (pulse measurement photodetector) by using the finger as an optical conductor as shown by arrow X in FIG. 16, and only light in the wavelength range not adversely affecting the detection results travels through the finger as an optical conductor. Because virtually all light below 300 nm is absorbed by the skin surface, the effective (real) wavelength detection range is 300 nm–700 nm even if the detection wavelength range is simply defined as below 700 nm.

It is therefore possible to suppress the effects of external light by covering only the smallest necessary area and not covering a large part of the finger. If a small sensor unit 30 is used as described in this embodiment, the hand can be freely closed with sensor unit 30 worn at the base of the finger, and there is no interference with running. Furthermore, because cable 20 can be shortened if sensor unit 30 is worn at the base of the finger, cable 20 will not get in the way while running.

It is also known that the temperature drop at the base of the finger is relatively low even in cold weather, and it is therefore possible to reliably measure the pulse rate even when running outdoors on a cold day because there is no significant drop in blood flow.

On the other hand, if an LED with an emissions peak near 880 nm and a silicon pulse wave measurement phototransistor are used, the detection wavelength range will range from 350 nm to 1200 nm. Detection errors caused by variations in the external light can therefore occur easily with a conventional optical system (detection device) because the pulse wave is detected based on the detection results of external light with a wavelength of 1 μm, which travels easily using the finger as an optical conductor and thus reaches the photodetector as shown by arrow Y in FIG. 16.

Moreover, the signal-to-noise (S/N) ratio of the pulse signal based on the blood volume change is high because the pulse wave information is obtained using light in the wavelength range from approximately 300 nm to approximately 700 nm. Regarding the relationship between optical wavelength and the optical absorption characteristics of various hemoglobins, the absorption coefficient of hemoglobin in the blood to light of a wavelength from 300 nm to 700 nm is great, and is several times to approximately 100 times the absorption coefficient of 880 nm wavelength light.

It should be noted that a GaP type pulse measurement LED 31 having a primary emissions range from 540 nm to 570 nm, and a GaP type pulse measurement phototransistor 32 having a sensitivity range from 200 nm to nearly 700 nm, may also be used if the objective is to obtain pulse information with no interference from external light.

Major effects of the preferred embodiment

As described above, when the terminal voltage of battery 59 drops while executing additional measurements such as measuring the pulse in wristwatch type pulse wave measuring device 1 according to the present invention, battery cover 118 is first removed to remove battery 59 from battery housing hole 509 as shown in FIG. 5. Spring member 197 thus pushes switch end 190, which is pressed to the side by battery 59 in battery housing hole 509, into battery housing hole 509 as shown in FIGS. 6–8, and switch end 190 inputs the terminal voltage of capacitance elements 528 and 558 to IC 56 through no battery signal input terminal 510. It is therefore possible to easily and automatically detect by simply removing and loading battery 59 whether battery 59 is housed in battery housing hole 509.

Mode switching means 564 therefore automatically switches to an energy conservation mode whereby added operations such as measuring the pulse are stopped when it is determined that battery 59 is not housed in battery housing hole 509. Normal clock operation is also not interrupted in this energy conservation mode when battery 59 is replaced because the charged stored to backup power supply capacitance elements 528 and 558 is sufficient to maintain minimal operations such as the clock and memory backup for an expanded period of time. It is therefore not necessary to readjust the clock after replacing battery 59 with wristwatch type pulse wave measuring device 1 according to the present invention, and ease of use is good. Replacing battery 59 is also easy and convenient because other operations are thus not required to switch to an energy conservation mode.

When switch end 190 appears in battery housing hole 509, switch end 190 contacts side edge 511 of analog circuit board 51, and does not enter further into battery housing hole 509. As a result, battery 59 will not mash switch end 190 when battery 59 is loaded.

Switching mechanism 500 can also be simply achieved without adding to the wiring materials because an extension of conductive plate 19 electrically connecting capacitance elements 528 and 558 and battery 59 is a spring member used as switch end 190. As a result, switching mechanism 500 is suited to being incorporated inside a thin watch case 11. Because there are no extraneous wiring components, switching mechanism 500 also has the shock resistance characteristics suited to use in a portable electronic device such as wristwatch type pulse wave measuring device 1.

Battery 59 will also not become caught on switch end 190 because chamfer 195 contacting side edge 591 of battery 59 inserted to battery housing hole 509 is provided on switch end 190. As a result, switch end 190 operates reliably while being simply constructed.

The user can also immediately determine whether the newly inserted battery 59 is a new or old battery because mode switching means 564 can immediately display the battery terminal voltage detected by voltage detector 543 on LCD unit 13 when battery 59 is replaced.

Second Embodiment

Reference is now made to the battery presence detection switching mechanism 500 of the present invention may also be comprised using a switch end 190A that projects into the bottom of battery housing hole 509 when battery 59 is removed from battery housing hole 509. When battery 59 is removed from battery housing hole 509 in this case, switch end 190A rises up as a result of its inherent spring properties, causing contact 192A, which is formed by appropriately bending and shaping switch end 190A, to contact no battery signal input terminal 510A formed on the back of analog circuit board 51 as switch end 190A rises into battery housing hole 509. When battery 59 is loaded in battery housing hole 509, switch end 190A is pushed down and out of battery housing hole 509 by battery 59, thus separating contact 192A from no battery signal input terminal 510A.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

Reference Numerals

1 wristwatch type pulse wave measuring device
5 controller
10 device body
11 watch case
12 wrist band
13 LCD unit
15 first rear cover
16 second rear cover
19 conductive plate
31 LED (light-emitting element)
32 phototransistor (receptor)
50, 56 integrated circuit or IC
51 circuit board for analog circuits (circuit board)
58 piezoelectric element (sound-emitting element)
59 battery (main battery)
70 connector
80 connector piece
190, 190A switch end
191 spring member
192, 192A contact
195 chamfer
500 battery presence detection switching mechanism
510 input terminal formed on the side edge of the circuit board
510A input terminal formed on the back of the circuit board
528, 558 capacitance elements (auxiliary battery)
564 mode switching means
591 side edge of battery

What is claimed is:

1. A portable electronic device comprising a device body having a housing;

a circuit board disposed in said housing;

a main energy source housed in said housing;

an auxiliary energy source electrically connected in parallel to said main energy source;

a cover for selectively opening and closing said housing, wherein said main energy source is removable when said cover is opened;

a switching mechanism detachably coupled to said main energy source for being in a first state when said main energy source is housed in said housing and in a second state when said main energy source is absent from said housing; and a controller for controlling said portable electronic device in accordance with one of the first and second states of said switching mechanisms wherein said switching mechanism comprises a switch end for being in electrical connection with said auxiliary energy source, wherein said switch end contacts an input terminal of said circuit board when the main energy source is removed from said housing to provide said input terminal a signal to said controller corresponding to a voltage of said auxiliary energy source for indicating that the main energy source is absent from said housing in the second state, wherein said switch end is disconnected from said input terminal when the main energy source is housed in said housing in the first state, wherein said switch end selectively connects with and disconnects from said input terminal such that the switch end is forced into said housing when said main energy source is removed from said housing, and is pushed out from said housing by said main energy source when said main battery is housed in said housing, wherein said switch end comprises an extension of a conductive plate electrically connecting said auxiliary energy source and said main energy source housed in said housing, wherein said extension comprises a spring member projecting into said housing, wherein said switch end comprises a chamfer facing an opening of said housing arranged in a peripheral area of said housing, wherein said switch end is pushed to a side from said housing by a side edge of said main energy source contacting said chamfer when said main energy source is inserted into said housing, and wherein said switch end moves from the side into said housing to contact said input terminal when said main energy source is removed from said housing.

2. A portable electronic device according to claim 1, wherein said device body executes a plurality of operations, and wherein said controller comprises a mode switching means for switching from a normal operating mode to an energy conservation mode in which a portion of the plurality of operations executed by said device body are stopped when said switching mechanism determines that said main energy source is absent from said housing.

3. A portable electronic device according to claim 1, further comprising:

a piezoelectric element for emitting an audible alarm;

step-up means for providing an appropriate voltage to said piezoelectric element; and wherein said controller comprising a mode switching means for switching from a normal mode in which energy is supplied to said step-up means to an energy conservation mode in which energy is not supplied to said step-up means when said switching mechanism determines that said main energy source is absent from said housing.

4. A portable electronic device according to claim 1, further comprising:

a sensor unit having an optical emitter and a receptor for facing a finger surface;

a cable for inputting the optical detection result of said receptor from said sensor unit to said device body;

display unit;

a data processor disposed in said device body for obtaining pulse information for display on said display unit in accordance with the optical detection result of said receptor; and wherein said controller comprises a mode switching means for switching from a normal mode in which said data processor processes the pulse information to an energy conservation mode in which said data processor does not process the pulse information, when said switching mechanism determines that said main energy source is absent from said housing.

5. A portable electronic device according to claim 1, further comprising:

a display unit for displaying various information;

step-up means for providing an appropriate voltage to display information on said display unit; and wherein said controller comprising mode switching means for switching from a normal mode in which energy is supplied from said main energy source to said step-up means to an energy conservation mode in which energy is not supplied to said step-up means when said switching mechanism determines that said main energy source is absent from said housing.

6. A portable electronic device according to claim 1, further comprising:

a display unit for displaying various information;

voltage detection means for detecting a voltage of said main energy source housed in said housing; and wherein said controller comprises mode switching means for switching to a mode displaying a detection result from said voltage detection means on said display after said main energy source is inserted in said housing in accordance with said switching mechanism.

* * * * *